US008647803B2

(12) United States Patent
Yamamoto et al.

(10) Patent No.: US 8,647,803 B2
(45) Date of Patent: Feb. 11, 2014

(54) METHOD FOR PRODUCING COLORED RESIN PARTICLES, COLORED RESIN PARTICLES, DEVELOPER, IMAGE FORMING APPARATUS, IMAGE FORMING METHOD, AND PROCESS CARTRIDGE

(75) Inventors: Atsushi Yamamoto, Shizuoka (JP); Takuya Kadota, Hyogo (JP); Yoshihiro Mikuriya, Hyogo (JP); Tsuyoshi Nozaki, Osaka (JP); Yoshimichi Ishikawa, Hyogo (JP); Kazuoki Fuwa, Hyogo (JP); Tomohiro Fukao, Osaka (JP); Tomoharu Miki, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/363,912

(22) Filed: Feb. 1, 2012

(65) Prior Publication Data

US 2012/0251938 A1 Oct. 4, 2012

(30) Foreign Application Priority Data

Feb. 4, 2011 (JP) ..... 2011-022955

(51) Int. Cl.
*G03G 5/00* (2006.01)

(52) U.S. Cl.
USPC ..... 430/137.11; 430/110.2; 430/137.17

(58) Field of Classification Search
USPC ..... 430/110.2, 137.11, 137.17
See application file for complete search history.

(56) References Cited

U.S. PATENT DOCUMENTS

| | | | | |
|---|---|---|---|---|
| 4,221,862 | A | 9/1980 | Naito et al. | |
| 4,965,131 | A | 10/1990 | Nair et al. | |
| 7,550,242 | B2 | 6/2009 | Nozaki et al. | |
| 7,678,522 | B2 | 3/2010 | Nakamura et al. | |
| 7,709,171 | B2 | 5/2010 | Yamamoto et al. | |
| 7,785,760 | B2 | 8/2010 | Yamamoto et al. | |
| 7,811,735 | B2 | 10/2010 | Nakamura et al. | |
| 7,829,254 | B2 | 11/2010 | Kurose et al. | |
| 7,867,682 | B2 | 1/2011 | Nozaki et al. | |
| 7,903,998 | B2 | 3/2011 | Matsumoto et al. | |
| 8,012,658 | B2 | 9/2011 | Nozaki et al. | |
| 8,039,185 | B2 | 10/2011 | Matsumoto et al. | |
| 8,062,821 | B2 | 11/2011 | Yamamoto et al. | |
| 2007/0218390 | A1 | 9/2007 | Nozaki et al. | |
| 2008/0076054 | A1* | 3/2008 | Nozaki et al. | 430/110.2 |

(Continued)

FOREIGN PATENT DOCUMENTS

| | | |
|---|---|---|
| JP | 61-28688 | 7/1986 |
| JP | 63-25664 | 2/1988 |

(Continued)

*Primary Examiner* — Stewart Fraser
(74) *Attorney, Agent, or Firm* — Oblon, Spivak, McClelland, Maier & Neustadt, L.L.P.

(57) ABSTRACT

A method for producing colored resin particles including: dissolving or dispersing at least binder resin and colorant in organic solvent to prepare oil phase; dissolving resin A and basic compound in aqueous medium to prepare aqueous phase, the resin A having solubility <2.0 g/100 g water having temperature 25° C. and pH 3.0 and solubility ≥2.0 g/100 g water having temperature 25° C. and pH 10.0; dispersing the oil phase in the aqueous phase to prepare core particle dispersion liquid; dispersing resin particles in aqueous medium to prepare resin particle dispersion liquid, and adding the resin particle dispersion liquid to the core particle dispersion liquid so that the resin particles are attached onto the core particles, to prepare dispersion liquid containing particles each having the core particle and the resin particles attached thereonto; removing the organic solvent from the dispersion liquid; washing the particles; and drying the particles.

19 Claims, 3 Drawing Sheets

(56) References Cited

U.S. PATENT DOCUMENTS

| | | | |
|---|---|---|---|
| 2008/0096119 | A1 | 4/2008 | Yamamoto et al. |
| 2008/0176159 | A1 | 7/2008 | Matsumoto et al. |
| 2008/0227001 | A1 | 9/2008 | Kadota et al. |
| 2008/0227013 | A1 | 9/2008 | Kadota et al. |
| 2008/0227016 | A1 | 9/2008 | Nozaki et al. |
| 2008/0233497 | A1 | 9/2008 | Yamamoto et al. |
| 2008/0233510 | A1 | 9/2008 | Nozaki et al. |
| 2008/0233511 | A1 | 9/2008 | Ishikawa et al. |
| 2009/0017391 | A1 | 1/2009 | Yamamoto et al. |
| 2009/0220879 | A1 | 9/2009 | Matsumoto et al. |
| 2009/0233199 | A1 | 9/2009 | Nozaki et al. |
| 2009/0297975 | A1 | 12/2009 | Ishikawa et al. |
| 2010/0055603 | A1 | 3/2010 | Nozaki et al. |
| 2010/0239974 | A1 | 9/2010 | Nozaki et al. |
| 2011/0053063 | A1 | 3/2011 | Kadota et al. |
| 2011/0053071 | A1 | 3/2011 | Miki et al. |
| 2011/0053077 | A1 | 3/2011 | Mikuriya et al. |
| 2011/0164901 | A1 | 7/2011 | Yamamoto et al. |
| 2011/0217644 | A1 | 9/2011 | Yamamoto et al. |
| 2011/0244383 | A1 | 10/2011 | Yamamoto et al. |
| 2011/0250533 | A1 | 10/2011 | Kadota et al. |
| 2011/0287356 | A1 | 11/2011 | Fukao et al. |

FOREIGN PATENT DOCUMENTS

| | | |
|---|---|---|
| JP | 2-43225 | 2/1990 |
| JP | 3455523 | 7/2003 |
| JP | 2006-285188 | 10/2006 |
| JP | 2007-25655 | 2/2007 |
| JP | 4134057 | 6/2008 |
| JP | 4364812 | 8/2009 |
| JP | 4625386 | 11/2010 |
| JP | 2011-46865 | 3/2011 |
| JP | 2011-185961 | 9/2011 |

* cited by examiner

METHOD FOR PRODUCING COLORED RESIN PARTICLES, COLORED RESIN PARTICLES, DEVELOPER, IMAGE FORMING APPARATUS, IMAGE FORMING METHOD, AND PROCESS CARTRIDGE

BACKGROUND OF THE INVENTION

1. Field of the Invention

The present invention relates to a method for producing colored resin particles, colored resin particles produced by this method, a developer containing the colored resin particles, an image forming apparatus, an image forming method, and a process cartridge each using the developer.

2. Description of the Related Art

In electrophotographic image forming apparatuses, colored resin particles containing a colorant are used as a toner to form visible images. Colored resin particles are also used for image formation of electronic paper.

Previously proposed methods for producing colored resin particles used as a toner include: a method in which a binder resin such as a polyester resin, a colorant, a releasing agent, etc. are dissolved or dispersed in an organic solvent and the obtained oil phase is dispersed in an aqueous phase to produce colored resin particles (the dissolution suspension method); and a method in which fine polyester resin particles, fine pigment particles, fine releasing agent particles, etc. are aggregated in the presence of, for example, an aggregating salt for adjusting their shape to thereby produce colored resin particles (the emulsification association method) (see Japanese Patent Application Laid-Open (JP-A) No. 63-25664 and Japanese Patent Application Publication (JP-B) No. 61-28688).

Colored resin particles used for electrophotography and electronic paper preferably have a uniform particle diameter. The dissolution suspension method is suitably used for producing such colored resin particles that have a uniform particle diameter.

In view of this, as a method for producing particles having a uniform particle diameter by the dissolution suspension method, there has been proposed a method in which fine resin particles are dispersed in an aqueous phase and utilized to stabilize dispersion of liquid droplets of an oil phase (see Japanese Patent (JP-B) Nos. 3455523 and 4134057 and JP-A No. 02-43225). Specifically, there are proposed a method for producing resin particles in which liquid droplets of a resin solution (oil phase) are dispersed in an aqueous medium containing fine resin particles dispersed therein whereby dispersion of the oil phase liquid droplets are stabilized, and resin particles obtained by the method.

However, the dispersion stability of the oil droplets in these proposed techniques depends on, for example, properties as dispersion particles of fine resin particles such as particle diameter and zeta potential. In order to stably produce colored resin particles, it is necessary to strictly manage fine resin particles according to their particle diameter and zeta potential. Therefore, they have problems in production stability.

There has also been proposed a method in which an oil phase is dispersed in an aqueous phase to form oil droplets, and a dispersion liquid of fine vinyl resin particles is added to the obtained oil droplets dispersion liquid before or after removal of the solvent therefrom, followed by heating, to make the vinyl resin particles exist on the oil droplets or the particles from which the solvent has been removed (see JP-A No. 2006-285188).

This proposed technique involves heating at a high temperature of 70° C. or higher for surely attaching the vinyl resin particles onto the particles as cores, requiring a large amount of energy. Thus, this method is not a preferred method from an economical viewpoint and in consideration of environmental load.

When a vinyl resin having less polar groups such as a carboxyl group is added before removal of the solvent, oil droplets decrease in dispersion stability to cause aggregation or agglomeration between the oil droplets, raising a problem that colored resin particles having a uniform particle diameter cannot stably be produced.

At present, demand has arisen for development of a method for producing colored resin particles by the dissolution suspension method, which can stably produce colored resin particles having a uniform particle diameter and can require less energy for the production, colored resin particles produced by this method, a developer containing the colored resin particles, and an image forming apparatus, an image forming method, and a process cartridge each using the developer.

SUMMARY OF THE INVENTION

The present invention aims to solve the above existing problems and achieve the following objects. Specifically, an object of the present invention is to provide: a method for producing colored resin particles by the dissolution suspension method, which can stably produce colored resin particles having a uniform particle diameter and can require less energy for the production; colored resin particles produced by this method, a developer containing the colored resin particles, and an image forming apparatus, an image forming method, and a process cartridge each using the developer.

Means for Solving the Problems are as Follows

<1> A method for producing colored resin particles, including:

dissolving or dispersing at least a binder resin and a colorant in an organic solvent to prepare an oil phase;

dissolving resin A and a basic compound in an aqueous medium to prepare an aqueous phase, where the resin A has a solubility less than 2.0 g in 100 g of water having a temperature of 25° C. and a pH of 3.0 and has a solubility equal to or more than 2.0 g in 100 g of water having a temperature of 25° C. and a pH of 10.0;

dispersing the oil phase in the aqueous phase to prepare a core particle dispersion liquid in which core particles formed of the oil phase are dispersed;

dispersing fine resin particles in an aqueous medium to prepare a fine resin particle dispersion liquid, and adding the fine resin particle dispersion liquid to the core particle dispersion liquid so that the fine resin particles are attached onto the core particles, to thereby prepare a dispersion liquid containing particles each having the core particle and the fine resin particles attached onto the core particle;

removing the organic solvent from the dispersion liquid containing the particles each having the core particle and the fine resin particles attached onto the core particle;

washing, after the removing, the particles each having the core particle and the fine resin particles attached onto the core particle; and drying, after the washing, the particles each having the core particle and the fine resin particles attached onto the core particle.

<2> The method for producing colored resin particles according to <1>, wherein the resin A is a resin obtained by reacting a monomer mixture containing at least a monomer compound having a structure expressed by the following Chemical Formula (1) and a monomer compound represented by the following General Formula (2), where the resin contains the monomer compound having a structure expressed by Chemical Formula (1) in an amount of 20% by mass to 80% by mass relative to the total constituent monomers of the resin, and contains the monomer compound represented by General Formula (2) in an amount of 15% by mass to 65% by mass relative to the total constituent monomers of the resin:

Chemical Formula (1)

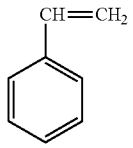

General Formula (2)

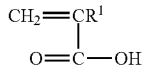

where $R^1$ denotes a hydrogen atom or a methyl group.

<3> The method for producing colored resin particles according to <2>, wherein the monomer mixture further contains a monomer compound represented by the following General Formula (3):

General Formula (3)

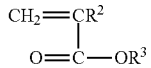

where $R^2$ denotes a hydrogen atom or a methyl group, and $R^3$ denotes a C1-C22 hydrocarbon group.

<4> The method for producing colored resin particles according to <2> or <3>, wherein the monomer mixture further contains a monomer compound represented by the following General Formula (4):

General Formula (4)

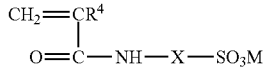

where $R^4$ denotes a hydrogen atom or a methyl group, X denotes a divalent hydrocarbon group, M denotes a hydrogen atom, sodium, potassium or a C1-C4 hydrocarbon group.

<5> The method for producing colored resin particles according to any one of <2> to <4>, wherein the resin A is a resin obtained by reacting the monomer mixture using a water-soluble radical generator in an aqueous medium containing a surfactant.

<6> The method for producing colored resin particles according to any one of <2> to <4>, wherein the resin A is a resin obtained by reacting the monomer mixture using a radical generator in a solvent where the monomer mixture and the radical generator are soluble.

<7> The method for producing colored resin particles according to any one of <1> to <6>, wherein the binder resin is a resin having a polyester skeleton.

<8> The method for producing colored resin particles according to <7>, wherein the resin having a polyester skeleton is a polyester resin.

<9> The method for producing colored resin particles according to any one of <1> to <8>, wherein the oil phase further contains an isocyanate group-containing modified resin.

<10> The method for producing colored resin particles according to <9>, wherein the isocyanate group-containing modified resin has a polyester skeleton.

<11> The method for producing colored resin particles according to <9> or <10>, wherein the oil phase further contains an amine compound containing a divalent or higher valent amino group reactive with the isocyanate group of the isocyanate group-containing modified resin.

<12> The method for producing colored resin particles according to any one of <1> or <11>, wherein the basic compound is a compound formed of a cation selected from the group consisting of alkali metals and alkaline earth metals and an anion selected from the group consisting of a hydroxyl group, a $COO^{2-}$ group, a $HCOO^-$ group, a $PO_4^{3-}$ group, a $HPO_4^{2-}$ group and a $H_2PO_4^-$ group.

<13> The method for producing colored resin particles according to any one of <1> or <12>, wherein the fine resin particles are fine vinyl resin particles.

<14> The method for producing colored resin particles according to <13>, wherein the fine vinyl resin particles are obtained by polymerizing a monomer mixture containing in an amount of 7% by mass or less a compound containing a vinyl polymerizable functional group and an acid group.

<15> The method for producing colored resin particles according to <13> or <14>, wherein the fine vinyl resin particles are obtained by polymerizing a monomer mixture containing in an amount of 80% by mass or more an aromatic compound containing a vinyl polymerizable functional group.

<16> Colored resin particles obtained by the method for producing colored resin particles according to any one of <1> to <15>.

<17> A developer including:

the colored resin particles according to <16>.

<18> An image forming apparatus including:

an image bearing member;

a latent electrostatic image forming unit configured to form a latent electrostatic image on the image bearing member;

a developing unit configured to develop the latent electrostatic image with a developer to form a visible image;

a transfer unit configured to transfer the visible image to a recording medium; and a fixing unit configured to fix the transferred image on the recording medium, wherein the developing unit houses the developer according to <17>.

<19> An image forming method including:

forming a latent electrostatic image on an image bearing member;

developing the latent electrostatic image with the developer according to <17> to form a visible image;

transferring the visible image to a recording medium; and fixing the transferred image on the recording medium.

<20> A process cartridge including:

an image bearing member; and a developing unit which houses the developer according to <17>, wherein the process cartridge is detachably mounted to the main body of an image forming apparatus.

The present invention can provide a method for producing colored resin particles by the dissolution suspension method, which can stably produce colored resin particles having a uniform particle diameter and can require less energy for the production. This method can solve the existing problems.

DETAILED DESCRIPTION OF THE INVENTION

Figure 1:
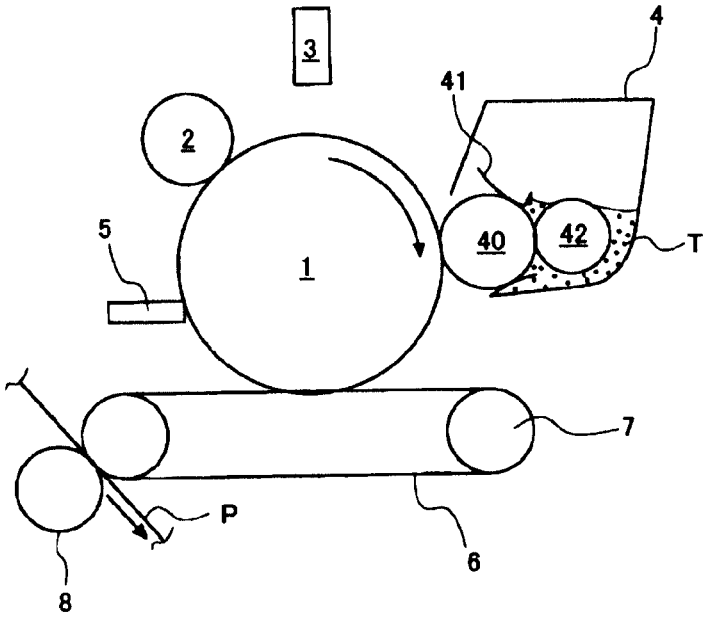
FIG. 1 is a schematic cross-sectional view of one exemplary image forming apparatus of the present invention.

Method for Producing Colored Resin Particles, and Colored Resin Particles

A method of the present invention for producing colored resin particles includes at least an oil phase preparation step, an aqueous phase preparation step, a dispersion liquid preparation step, a fine resin particles attachment step, a solvent removal step, a washing step and a drying step; and, if necessary, further includes other steps.

Colored resin particles of the present invention are obtained by the method of the present invention for producing colored resin particles.

<Oil Phase Preparation Step>

The oil phase preparation step is not particularly limited, so long as it is a step of dissolving or dispersing at least a binder resin and a colorant in an organic solvent to prepare an oil phase, and may be appropriately selected depending on the intended purpose.

The oil phase preparation step is performed by, for example, a method in which the binder resin, the colorant, and other ingredients are gradually added to the organic solvent under stirring to dissolve or disperse them in the organic solvent. When a pigment is used as the colorant or when ingredients poorly dissolvable in the organic solvent such as a releasing agent and a charge controlling agent are added to the organic solvent, these ingredients are preferably micronized prior to the addition to the organic solvent.

The below-described formation of the colorant into a masterbatch is one suitable method, and the same method can be applied to the releasing agent and the charge controlling agent.

In another employable method, the colorant, the releasing agent, the charge controlling agent, and other ingredients are dispersed through a wet process in the presence of an optionally added dispersing aid to prepare a wet master.

Alternatively, when dispersing ingredients that melt at a temperature lower than the melting point of the organic solvent, these ingredients are heated and dissolved once while being stirred in the organic solvent together with the dispersoids in the presence of an optionally added dispersion aid, followed by cooling with stirring or shearing for precipitation, to thereby form microcrystals of the dispersoids.

After the colorant and, if necessary, the releasing agent and the charge controlling agent which have been dispersed by the above method are dissolved or dispersed in the organic solvent together with the binder resin, the resultant liquid may further be dispersed. This dispersion can be performed using a known disperser such as a beads mill or a disc mill.

When colored resin particles are used as a latent electrostatic image developing toner, the colored resin particles are preferably produced with an isocyanate group-containing modified resin dissolved in the oil phase, i.e., with the oil phase containing an isocyanate group-containing modified resin, for the purposes of increasing the mechanical strength of the obtained colored resin particles and preventing high temperature offset during fixing.

—Binder Resin—

The binder resin is not particularly limited and may be appropriately selected depending on the intended purpose. When the colored resin particles are used as a latent electrostatic image developing toner for electrophotography, the binder resin is preferably a resin having a polyester skeleton since good fixability can be obtained. Examples of the resin having a polyester skeleton include a polyester resin and a block copolymer of a polyester resin and a resin having another skeleton. Among them, a polyester resin is preferred since the obtained colored resin particles become highly uniform.

The acid value of the binder resin is not particularly limited and may be appropriately selected depending on the intended purpose, but is preferably 2 mgKOH/g to 24 mgKOH/g. When the acid value is less than 2 mgKOH/g, the binder resin decreases in polarity, and thus it may be difficult for the colorant having a certain degree of polarity to be uniformly dispersed in oil droplets. When the acid value is higher than 24 mgKOH/g, the binder resin is easily transferred to the aqueous phase, and as a result there may be waste of the binder resin during the production and degradation of dispersion stability of the oil droplets.

--Polyester Resin--

The polyester resin is not particularly limited and may be appropriately selected depending on the intended purpose. Examples thereof include ring-opening polymers of lactones, polycondensates of hydroxycarboxylic acid, and polycondensates formed between polyols and polycarboxylic acids. Among them, polycondensates formed between polyols and polycarboxylic acids are preferred since their composition can variably be adjusted.

---Polyol---

Polyol (1) is not particularly limited and may be appropriately selected depending on the intended purpose. Examples of the polyol (1) include diols (1-1) and trihydric or higher polyols (1-2), with (1-1) alone or a mixture containing (1-1) and a small amount of (1-2) being preferred.

Examples of the diol (1-1) include alkylene glycols (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexanedimethanol and hydrogenated bisphenol A); bisphenols (e.g., bisphenol A, bisphenol F and bisphenol S); and adducts of the above-listed alicyclic diols with alkylene oxides (e.g., ethylene oxide, propylene oxide and butylene oxide). Of these, preferred are C2 to C12 alkylene glycols and alkylene oxide adducts of bisphenols. More preferred are combinations of alkylene oxide adducts of bisphenols and C2 to C12 alkylene glycols.

Examples of the trihydric or higher polyols (1-2) include trihydric to octahydric or higher aliphatic alcohols (e.g., glycerin, trimethylolethane, trimethylolpropane, pentaerythritol and sorbitol); trihydric or higher phenols (e.g., trisphenol PA, phenol novolac and cresol novolac); and alkylene oxide adducts of the above trihydric or higher polyphenols.

These may be used alone or in combination.

---Polycarboxylic Acid---

Polycarboxylic acid (2) is not particularly limited and may be appropriately selected depending on the intended purpose. Examples of the polycarboxylic acid (2) include dicarboxylic acids (2-1) and trivalent or higher polycarboxylic acids (2-2), with (2-1) alone or a mixture containing (2-1) and a small amount of (2-2) being preferred.

Examples of the dicarboxylic acid (2-1) include alkylene dicarboxylic acids (e.g., succinic acid, adipic acid and sebacic acid); alkenylene dicarboxylic acids (e.g., maleic acid and fumaric acid); and aromatic dicarboxylic acids (e.g., phthalic acid, isophthalic acid, terephthalic acid and naphthalene dicarboxylic acid). Of these, preferred are C4 to C20 alkenylenedicarboxylic acids and C8 to C20 aromatic dicarboxylic acids.

Examples of the trivalent or higher polycarboxylic acid (2-2) include C9 to C20 aromatic polycarboxylic acids (e.g., trimellitic acid and pyromellitic acid). Notably, the polycarboxylic acid (2) to be reacted with the polyol (1) may be acid anhydrides or lower alkyl esters (e.g., methyl ester, ethyl ester and isopropyl ester) of the above carboxylic acids.

These may be used alone or in combination.

The ratio between the polyol (1) and the polycarboxylic acid (2) is generally 2/1 to 1/2, preferably 1.5/1 to 1/1, more preferably 1.3/1 to 1.02/1, in terms of the equivalent ratio [OH]/[COOH] of the hydroxyl group [OH] to the carboxyl group [COOH].

The weight average molecular weight of the polyester resin is not particularly limited and may be appropriately selected depending on the intended purpose. It is preferably 1,000 to 30,000, more preferably 1,500 to 15,000. When the weight average molecular weight is lower than 1,000, the formed colored resin particles may degrade in heat resistant storage stability. When the weight average molecular weight is higher than 30,000, the formed colored resin particles may degrade in low temperature fixability required for a latent electrostatic image developing toner. The weight average molecular weight falling within the above more preferred range is advantageous in achieving both desired heat resistant storage stability and desired low temperature fixability.

The above weight average molecular weight refers to a molecular weight measured through GPC (gel permeation chromatography) and can be measured by, for example, GPC-150C (product of Waters Co.).

The glass transition temperature of the polyester resin is not particularly limited and may be appropriately selected depending on the intended purpose. It is preferably 35° C. to 80° C., more preferably 40° C. to 70° C., particularly preferably 45° C. to 65° C. When the glass transition temperature is lower than 35° C., the obtained colored resin particles may deform under high-temperature conditions such as in midsummer, or the obtained colored resin particles adhere to each other whereby they cannot behave as particles in some cases. When the glass transition temperature is higher than 80° C., the obtained colored resin particles may degrade in fixability when used as a latent electrostatic image developing toner.

The glass transition temperature refers to a glass transition temperature measured through differential scanning calorimety (DSC) and can be measured by, for example, TG-DSC System TAS-100 (product of Rigaku Corporation).

—Colorant—

The colorant is not particularly limited and may be appropriately selected depending on the intended purpose. Examples thereof include carbon black, nigrosine dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS and BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian, emerald green, pigment green B, naphthol green B, green gold, acid green lake, malachite green lake, phthalocyanine green, anthraquinon green, titanium oxide, zinc flower and lithopone.

The amount of the colorant is not particularly limited and may be appropriately selected depending on the intended purpose. It is preferably 1% by mass to 15% by mass, more preferably 3% by mass to 10% by mass, relative to the colored resin particles produced.

The colorant may be mixed with a resin to form a masterbatch. Examples of the resin which is used for producing a masterbatch or which is kneaded together with a masterbatch include the above polyester resins; styrene polymers and substituted products thereof (e.g., polystyrenes, poly-p-chlorostyrenes and polyvinyltoluenes); styrene copolymers (e.g., styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloro methacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers); polymethyl methacrylate s; polybutyl methacrylate s; polyvinyl chlorides; polyvinyl acetates; polyethylenes; polypropylenes, polyesters; epoxy resins; epoxy polyol resins; polyurethanes; polyamides; polyvinyl butyrals; polyacrylic acid resins; rosin; modified rosin; terpene resins; aliphatic or alicyclic hydrocarbon resins; aromatic petroleum resins; chlorinated paraffins; and paraffin waxes. These may be used alone or in combination.

The masterbatch can be prepared by mixing/kneading a colorant with a resin for use in a masterbatch through application of high shearing force. Also, an organic solvent may be used for improving mixing between these materials. Further, the flashing method, in which an aqueous paste containing a colorant is mixed/kneaded with a resin and an organic solvent and then the colorant is transferred to the resin to remove water and the organic solvent, is preferably used, since a wet cake of the colorant can be directly used (i.e., no drying is required). In this mixing/kneading, a high-shearing disperser (e.g., three-roll mill) is preferably used.

—Isocyanate Group-Containing Modified Resin—

The isocyanate group-containing modified resin is not particularly limited and may be appropriately selected depending on the intended purpose. The skeleton of the modified resin is preferably the same as that of the resin dissolved in an organic solvent in consideration of uniformity of the resultant particles. Preferred is a modified resin having a polyester skeleton; i.e., isocyanate group-containing polyester prepolymer (A). Examples of the isocyanate group-containing polyester prepolymer (A) include a reaction product between polyisocyanate (3) and an active hydrogen group-containing polyester, which is a polycondensate between polyol (1) and polycarboxylic acid (2). Examples of the active hydrogen group contained in the polyester prepolymer (A) include a hydroxyl group (an alcoholic hydroxyl group or phenolic hydroxyl group), an amino group, a carboxyl group and a mercapto group, with an alcoholic hydroxyl group being preferred.

Examples of the polyol (1) and the polycarboxylic acid (2) include the polyol (1) and the polycarboxylic acid (2) described above for the polyester resin.

The polyisocyanate (3) is not particularly limited and may be appropriately selected depending on the intended purpose. Examples thereof include aliphatic polyisocyanates (e.g., tetramethylene diisocyanate, hexamethylene diisocyanate and 2,6-diisocyanatomethylcaproate); alicyclic polyisocyanates (e.g., isophorone diisocyanate and cyclohexylmethane diisocyanate); aromatic diisocyanates (e.g., tolylene diisocyanate and diphenylmethane diisocyanate); aroma-aliphatic diisocyanates (e.g., α, α, α', α'-tetramethylxylylene diisocyanate); isocyanurates; products obtained by blocking the above-listed polyisocyanates with, for example, a phenol derivative, an oxime or caprolactam; and mixtures thereof.

The equivalent ratio [NCO]/[OH] of the isocyanate group [NCO] of the polyisocyanate (3) to the hydroxyl group [OH] of the hydroxyl group-containing polyester is not particularly limited and may be appropriately selected depending on the intended purpose. It is preferably 5/1 to 1/1, more preferably 4/1 to 1.2/1, particularly preferably 2.5/1 to 1.5/1. When the equivalent ratio [NCO]/[OH] exceeds 5/1, the resultant colored resin particles may be degraded in low temperature fixability when used as a toner. When the equivalent ratio [NCO]/[OH] is less than 1/1, the urea content of the polyester prepolymer (1) may decrease and the resultant colored resin particles may be degraded in hot offset resistance when used as a toner. In the isocyanate group-containing polyester prepolymer (A), the amount of the constituent component derived from the polyisocyanate (3) is generally 0.5% by mass to 40% by mass, preferably 1% by mass to 30% by mass, more preferably 2% by mass to 20% by mass.

The isocyanate group-containing polyester prepolymer (A) generally has, in one molecule thereof, one or more isocyanate groups, preferably 1.5 groups to 3 groups on average, more preferably 1.8 groups to 2.5 groups on average.

—Amine Compound (Amine Compound Having Divalent or Higher Valent Amino Group Reactive with Isocyanate Group)—

When the oil phase contains the isocyanate group-containing modified resin, the oil phase preferably contains an amine compound having divalent or higher valent amino group reactive with the isocyanate group of the isocyanate group-containing modified resin.

In the process of dispersing the oil phase in an aqueous phase to form particles, the isocyanate group of the isocyanate group-containing modified resin is partially hydrolyzed to an amino group, and the formed amino group reacts with unreacted isocyanate groups to proceed with elongation reaction. Also, for the purpose of surely proceeding with the elongation reaction or introducing a crosslinked point, combinational use of the amine compound is preferred.

Examples of the amine compound (B) diamines (B1), tri or higher valent polyamines (B2), aminoalcohols (B3), aminomercaptans (B4), amino acids (B5) and compounds (B6) obtained by blocking the amino groups of the (B1) to (B5).

Examples of the diamines (B1) include aromatic diamines (e.g., phenylenediamine, diethyltoluenediamine and 4,4'-diaminodiphenylmethane); alicyclic diamines (e.g., 4,4'-diamino-3,3'-dimethyldicyclohexylmethane, diaminecyclohexane and isophoronediamine); and aliphatic diamines (e.g., ethylenediamine, tetramethylenediamine and hexamethylenediamine).

Examples of the tri or higher polyamines (B2) include diethylenetriamine and triethylenetetramine.

Examples of the aminoalcohols (B3) include ethanolamine and hydroxyethylaniline.

Examples of the aminomercaptans (B4) include aminoethyl mercaptan and aminopropyl mercaptan.

Examples of the amino acids (B5) include aminopropionic acid and aminocaproic acid.

Examples of the compounds (B6) obtained by blocking the amino groups of the (B1) to (B5) include oxazoline compounds and ketimine compounds derived from the amine compounds (B1) to (B5) and ketones (e.g., acetone, methyl ethyl ketone and methyl isobutyl ketone).

These may be used alone or in combination.

Among these amine compounds (B), preferred are B1 and a mixture of B1 and a small amount of B2.

If necessary, a reaction terminator may be used for terminating crosslinking and/or elongating to adjust the molecular weight of the modified resin obtained after completion of reaction. Examples of the reaction terminator include monoamines (e.g., diethyl amine, dibutyl amine, butyl amine and lauryl amine) and blocked products thereof (e.g., ketimine compounds).

The equivalent ratio [NCO]/[NHx] of the isocyanate group [NCO] of the isocyanate group-containing polyester prepolymer (A) to the amino group [NHx] of the amine compound (B) is not particularly limited and may be appropriately selected depending on the intended purpose. It is preferably 1/2 to 2/1, more preferably 1.5/1 to 1/1.5, particularly preferably 1.2/1 to 1/1.2.

—Organic Solvent—

The organic solvent is not particularly limited and may be appropriately selected depending on the intended purpose. The organic solvent preferably has a boiling point of lower than 100° C. since such an organic solvent can easily be removed. Examples of such organic solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone.

These solvents may be used alone or in combination.

When the binder resin to be dissolved or dispersed in the organic solvent is a resin having a polyester skeleton, use of ester solvents such as methyl acetate, ethyl acetate and butyl acetate, and ketone solvents such as methyl ethyl ketone and methyl isobutyl ketone is preferred since they are excellent in dissolution capability. Among them, particulary preferred are methyl acetate, ethyl acetate and methyl ethyl ketone since they can easily be removed.

—Releasing Agent—

When the colored resin particles produced by the above production method are used as a latent electrostatic image developing toner, a releasing agent is preferably dispersed in the organic solvent for the purpose of improving fixing releasability.

The releasing agent is preferably a compound which exhibits sufficiently low viscosity upon heating during the fixing process and is hardly swollen or compatible to the surface of a fixing member; e.g., wax and silicone oil. Considering the storage stability of the colored resin particles, more preferred is use of wax that generally exists as a solid in the colored resin particles during storage.

The wax is not particularly limited and may be appropriately selected depending on the intended purpose. Examples thereof include long-chain hydrocarbons and carbonyl group-containing waxes.

Examples of the long-chain hydrocarbons include polyolefin waxes (e.g., polyethylene wax and polypropylene wax); petroleum waxes (e.g., paraffin waxes, SASOL wax and microcrystalline waxes); and Fischer-Tropsch waxes.

Examples of the carbonyl group-containing waxes include polyalkanoic acid esters (e.g., carnauba wax, montan wax, trimethylolpropane tribehenate, pentaerythritol tetrabehenate, pentaerythritol diacetatedibehenate, glycerine tribehenate and 1,18-octadecanediol distearate); polyalkanol esters (e.g., tristearyl trimellitate and distearyl malleate); polyalkanoic acid amides (e.g., ethylenediamine dibehenylamide); polyalkylamides (e.g., trimellitic acid tristearylamide); and dialkyl ketones (e.g., distearyl ketone).

Of these, long-chain hydrocarbons are preferred since they exhibit better releasing performance. Furthermore, the long-chain hydrocarbons may be used in combination with the carbonyl group-containing waxes.

The amount of the releasing agent contained in the colored resin particles is preferably 2% by mass to 25% by mass, more preferably 3% by mass to 20% by mass, particularly preferably 4% by mass to 15% by mass. When it is less than 2% by mass, the releasing agent cannot exhibit the fixing releasability-improving effect in some cases. When it is more than 25% by mass, the formed colored resin particles are degraded in mechanical strength.

—Charge Controlling Agent—

If necessary, a charge controlling agent may be dissolved or dispersed in the organic solvent in advance.

The charge controlling agent is not particularly limited and may be appropriately selected depending on the intended purpose. Examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine active agents, metal salts of salicylic acid, and metal salts of salicylic acid derivatives. Specific examples include nigrosine dye BONTRON 03, quaternary ammonium salt BONTRON P-51, metal-containing azo dye BONTRON S-34, oxynaphthoic acid-based metal complex E-82, salicylic acid-based metal complex E-84 and phenol condensate E-89 (these products are of ORIENT CHEMICAL INDUSTRIES CO., LTD), quaternary ammonium salt molybdenum complex TP-302 and TP-415 (these products are of Hodogaya Chemical Co., Ltd.), quaternary ammonium salt COPY CHARGE PSY VP 2038, triphenylmethane derivative COPY BLUE PR, quaternary ammonium salt COPY CHARGE NEG VP2036 and COPY CHARGE NX VP434 (these products are of Hoechst AG), LRA-901 and boron complex LR-147 (these products are of Japan Carlit Co., Ltd.), copper phthalocyanine, perylene, quinacridone, azo pigments, and polymeric compounds having, as a functional group, a sulfonic acid group, carboxyl group, quaternary ammonium salt, etc.

The amount of the charge controlling agent is not particularly limited and may be determined depending on the intended purpose. The amount of the charge controlling agent contained in the colored resin particles produced is preferably 0.5% by mass to 5% by mass, more preferably 0.8% by mass to 3% by mass.

<Aqueous Phase Preparation Step>

The aqueous phase preparation step is not particularly limited and may be appropriately selected depending on the intended purpose, so long as it is a step of dissolving resin A and a basic compound in an aqueous medium to prepare an aqueous phase, where the resin A has a solubility less than 2.0 g in 100 g of water having a temperature of 25° C. and a pH of 3.0 and has a solubility equal to or more than 2.0 g in 100 g of water having a temperature of 25° C. and a pH of 10.0.

In the aqueous phase preparation step, the resin A is dissolved in the aqueous phase. Thus, the colored resin particles obtained after removal of the organic solvent have no protrusions formed by large particles having a diameter of 1.5 μm or more. The following may be a possible reason that the method of the present invention for producing colored resin particles involves no formation of protrusions formed by large particles having a diameter of 1.5 μm or more. For comparison, a conventionally known method for producing colored resin particles will be described. In the conventionally known method, fine particles (hereinafter referred to as "dispersion-stabilizing fine particles") are added in an aqueous medium to stabilize dispersion of oil droplets. When core particles of oil droplets are dispersed, some of the dispersion-stabilizing fine particles are not attached onto the interfaces between the oil droplets but freely exist in the aqueous medium. Thereafter, when fine resin particles (hereinafter referred to as "surface-attached fine particles") are added in order to be attached onto the surfaces of the core particles, the free dispersion-stabilizing fine particles are combined with the surface-attached fine particles to form large particles, which may be attached onto the surfaces of the oil droplets. In the method of the present invention for producing colored resin particles, instead of using the dispersion-stabilizing fine particles, a specific resin (the above resin A) is dissolved in the aqueous medium for stabilizing dispersion of the oil droplets (oil phase). Thus, at the stage of adding the surface-attached fine particles, no large particles are formed and as a result no protrusions formed by large particles having a diameter of 1.5 μm or more are formed.

Notably, when colored resin particles each having protrusions formed by large particles are used as a toner, such a toner is attached onto the blank portion, which is not preferred. This is likely because chargeability between toner particles is ununiform or chargeability on the toner surfaces is ununiform.

The pH of the aqueous phase is not particularly limited, so long as the resin A can be dissolved in the aqueous phase, and may be appropriately selected depending on the intended purpose. It is preferably 9.0 to 12.0 since the resin A can stably be dissolved in the aqueous phase and, in the below-described dispersion liquid preparation step, part of the organic solvent dissolves in the aqueous phase and the pH of the aqueous phase appropriately decreases to thereby allow the surface-attached fine particles to uniformly be attached while the resin A effectively stabilizes the interfaces between the oil droplets.

—Aqueous Medium—

The aqueous medium is not particularly limited and may be appropriately selected depending on the intended purpose, and examples thereof include water.

The aqueous medium may be water alone or a mixture of water and a water-miscible organic solvent. Examples of the water-miscible organic solvent include alcohols (e.g., methanol, isopropanol and ethylene glycol), dimethylformamide, tetrahydrofuran, cellosolves (e.g., methyl cellosolve) and lower ketones (e.g., acetone and methyl ethyl ketone).

—Resin A (Aqueous Phase-Added Resin)—

The resin A (hereinafter may be referred to as "aqueous phase-added resin") is not particularly limited and may be appropriately selected depending on the intended purpose, so long as it is a resin having a solubility less than 2.0 g in 100 g of water having a temperature of 25° C. and a pH of 3.0 and having a solubility equal to or more than 2.0 g in 100 g of water having a temperature of 25° C. and a pH of 10.0.

The aqueous phase-added resin is preferably a resin which is dissolved in the aqueous medium in the presence of a basic compound and in which a part of the resin dissolved precipitate when the oil phase is added to the aqueous medium.

Next will be described an evaluation method for solubility of the resin A in the present invention.

In the case of a dispersion where the resin is present as fine particles in an aqueous medium; in other words, when the resin is not dissolved in an aqueous medium, the dispersion is opaque as a whole due to scattering caused by the difference in refractive index between the fine resin particles and the medium. Meanwhile, when the resin is dissolved in an aqueous medium, the resultant liquid is a homogeneous phase as a whole not to involve scattering, and thus is transparent. In view of this, whether the resin is dissolved is determined based on transmittance of 600 nm light with respect to the resin dispersion or solution.

First, the resin dispersion is diluted with ion-exchange water while being adjusted in temperature to 25° C., and then further adjusted in pH, to thereby prepare 100 mL of a solution having a pH of 3.0 and a solid content concentration of 2.0% by mass. The pH adjustment is performed using 0.5N aqueous hydrochloric acid solution or 0.5N aqueous sodium hydroxide solution. Notably, the 0.5N aqueous sodium hydroxide solution is used to adjust the pH to 3.0 when the diluted liquid of the resin dispersion has a pH of lower than 3.0.

Next, the pH-adjusted liquid is stirred for 1 hour, and then a sample (2 mL) is taken therefrom and placed in a 1 cm×1 cm quartz cell. One minute after that, the sample is measured at 25° C. for transmittance (%) with respect to light having a wavelength of 600 nm using a UV-Vis spectrophotometer UV2550 (product of SHIMADZU CORPORATION) based on the following equation 1:

$$\text{Transmittance (\%)} = I/I0 \times 100 \qquad \text{Equation 1}$$

where I0 denotes an incident light flux and I denotes a transmitted light flux.

Here, ion-exchange water is used in a reference cell. When the fine resin particle dispersion contained the colorant that is unable to be removed, the colorant is added to ion-exchange water at the same concentration as that of the sample, and the resultant liquid is used in a reference cell.

When the transmittance is 95% or higher, the resin is considered to dissolve in the aqueous medium, and when the transmittance is lower than 95%, the resin is considered not to dissolve in the aqueous medium. That is, when the transmittance is 95% or higher, the target resin has a solubility equal to or more than 2.0 g in 100 g of water having a temperature of 25° C. and a pH of 3.0, and when the transmittance is lower than 95%, the target resin has a solubility less than 2.0 g in 100 g of water having a temperature of 25° C. and a pH of 3.0.

Next, in the same manner as in the above preparation method in which the pH is adjusted to 3.0, 100 mL of a solution having a pH of 10.0 and a solid content concentration of 2.0% by mass is prepared. The pH adjustment is performed using 2N aqueous sodium hydroxide solution. The pH-adjusted solution is stirred for 1 hour, and then a sample (2 mL) is taken therefrom. The sample is measured at 25° C. for transmittance (%) with respect to light having a wavelength of 600 nm in the same manner as described above, to thereby evaluate whether the resin dissolves in the aqueous medium.

When the transmittance is 95% or higher, the resin was considered to dissolve in the aqueous medium, and when the transmittance is lower than 95%, the resin was considered not to dissolve in the aqueous medium. That is, when the transmittance is 95% or higher, the target resin has a solubility equal to or more than 2.0 g in 100 g of water having a temperature of 25° C. and a pH of 10.0, and when the transmittance is lower than 95%, the target resin has a solubility less than 2.0 g in 100 g of water having a temperature of 25° C. and a pH of 10.0.

Notably, the solid content concentration of the resin dispersion is calculated from the loss of the resin dispersion after heating as follows: 2 g of the resin dispersion is placed in an aluminum dish and left to stand still at 150° C. for 30 min.

Also, when the resin is present in the form of solid matter rather than dispersion, the resin is finely pulverized with a mechanical pulverizer such as an oster blender and sieved with a mesh having an opening of 0.5 mm. Then, 2 g of the thus-treated resin is sampled and added to 98 g of ion-exchange water to prepare 2% by mass resin dispersion liquid. In this method, the particle diameter of the resin is larger than that in general resin dispersion liquids and thus the resin sediments when stirring is stopped. Even when the resin can be dissolved, the interface between the resin and the aqueous medium is small to require a long time for dissolution. Therefore, the stirring time after the pH adjustment is prolonged from 1 hour to 3 hours, and the sampling of the resin used for measurement of transmittance is performed while stirring the resin so as to be uniformly dispersed. In addition, the presence or absence of insoluble residual matter such as precipitates is visually confirmed, and when there is insoluble residual matter, the resin is not considered to dissolve.

The aqueous phase-added resin is preferably a resin obtained through reaction of a monomer mixture containing at least a monomer compound having a structure expressed by the following Chemical Formula (1) and a monomer compound represented by the following General Formula (2) (hereinafter the resin may be referred to as "resin B").

The resin B preferably has the monomer compound having a structure expressed by Chemical Formula (1) in an amount of 20% by mass to 80% by mass relative to the total constituent monomers of the resin B, and the monomer compound represented by General Formula (2) in an amount of 15% by mass to 65% by mass relative to the total constituent monomers of the resin B. By doing so, the resin B can have the above defined solubility.

Chemical Formula (1)

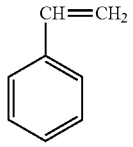

Chemical Formula (2)

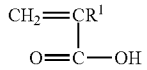

In General Formula (2), $R^1$ denotes a hydrogen atom or a methyl group.

The monomer compound having a structure of Chemical Formula (1) has an effect of increasing lipophilicity of the aqueous phase-added resin and also has an effect of imparting chargeability to the colored resin particles which are used as an electrophotographic toner. The resin B preferably has the monomer compound having a structure expressed by Chemical Formula (1) in an amount of 20% by mass to 80% by mass, more preferably 30% by mass to 70% by mass, particularly preferably 40% by mass to 60% by mass, relative to the total constituent monomers of the resin B. When the amount thereof is less than 20% by mass, the obtained colored resin particles may be degraded in chargeability when used as an electrophotographic toner. When the amount thereof exceeds 80% by mass, the aqueous phase-added resin becomes too high in lipophilicity to dissolve in the aqueous medium. In addition, the aqueous phase-added resin enters the oil droplets not to exhibit dispersion stability effects.

The monomer compound represented by General Formula (2) has a function of changing the resin B in its soluble or insoluble state in the aqueous medium depending on the pH or the dissolution of the organic solvent in the aqueous medium. To obtain this function, this monomer compound is preferably used in a specific range of amount. The resin B preferably has the monomer compound represented by General Formula (2) in an amount of 15% by mass to 65% by mass, more preferably 20% by mass to 50% by mass, particularly preferably 25% by mass to 45% by mass, relative to the total constituent monomers of the resin B. When the amount is less than 15% by mass, the resin B cannot be made to dissolve in the aqueous medium even in the presence of the basic compound, potentially making it difficult to stably disperse oil droplets or potentially making it impossible to uniformly disperse them. When the amount exceeds 65% by mass, the resin B is so high in affinity for the aqueous medium that it hardly changes to an insoluble state, or even when it changes to an insoluble state, it may be impossible for the insoluble particles to adsorb on the oil droplets for stabilizing dispersion thereof.

The monomer mixture may further contain the monomer compound represented by the following General Formula (3). This monomer compound adjusts the glass transition temperature of the resin B and thus it is possible to prevent the colored resin particles used as a toner from being degraded in fixability by the aqueous phase-added resin attached onto the surfaces of the colored resin particles.

General Formula (3)

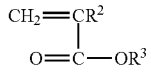

In General Formula (3), $R^2$ denotes a hydrogen atom or a methyl group, and $R^3$ denotes a C1-C22 hydrocarbon group.

The number of carbon atoms contained in $R^3$ is preferably 1 to 18, more preferably 2 to 10, particularly preferably 4 to 8.

The hydrocarbon group denoted by $R^3$ may be linear or branched.

Examples of the monomer compound represented by General Formula (3) include methyl acrylate, ethyl acrylate, n-propyl acrylate, isopropyl acrylate, n-butyl acrylate, isobutyl acrylate, tert-butyl acrylate, hexyl acrylate, octyl acrylate, 2-ethylhexyl acrylate, nonyl acrylate, decyl acrylate, lauryl acrylate, palmityl acrylate, myristyl acrylate, stearyl acrylate, behenyl acrylate, methyl methacrylate, ethyl methacrylate, n-propyl methacrylate, isopropyl methacrylate, n-butyl methacrylate, isobutyl methacrylate, tert-butyl methacrylate, hexyl methacrylate, octyl methacrylate, 2-ethylhexyl methacrylate, nonyl methacrylate, decyl methacrylate, lauryl methacrylate, palmityl methacrylate, myristyl methacrylate, stearyl methacrylate and behenyl methacrylate.

The monomer mixture may further contain a monomer compound represented by the following General Formula (4). This monomer compound can further increase the resin B in chargeability.

General Formula (4)

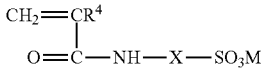

In General Formula (4), $R^4$ denotes a hydrogen atom or a methyl group, X denotes a divalent hydrocarbon group, and M denotes a hydrogen atom, sodium, potassium or a C1-C4 hydrocarbon group.

Examples of the divalent hydrocarbon group denoted by X include $—C(CH_3)_2—$ and $—C_6H_3(CH_3)—$.

Furthermore, a compound having a plurality of polymerizable functional groups may be used as a polymerizable monomer constituting the resin B. In order for the aqueous phase-added resin to dissolve in the aqueous medium, it is preferred that the amount of the compound having a plurality of polymerizable functional groups is adjusted to an amount of less than 1% by mass relative to the total polymerizable monomers. Examples of the compound having a plurality of polymerizable functional groups include diacrylate and dimethacrylate of various diol compounds (e.g., ethylene glycol, propylene glycol, 1,4-butanediol, 1,6-hexanediol, 1,8-octanediol, 1,9-nonanediol, bisphenol A or alkylene oxide adducts thereof, polyethylene glycol and polypropylene glycol), divinylbenzene, glycerol triacrylate, and pentaerythritol tetraacrylate.

The acid value of the resin A is not particularly limited and may be appropriately selected depending on the intended purpose. It is preferably 100 mgKOH/g to 300 mgKOH/g, more preferably 140 mgKOH/g to 200 mgKOH/g, since the resin A having such an acid value has the above-defined solubility.

The acid value can be measured by, for example, the measurement method described in JIS K0070-1992 as follows. Specifically, a sample solution is titrated with a pre-standardized N/10 potassium hydroxide alcohol solution and then the acid value is calculated from the amount of the potassium hydroxide alcohol solution consumed using the following equation:

$$\text{Acid value}=\text{KOH (mL)}\times N\times 56.1/\text{mass of sample}$$

where N is a factor of N/10 KOH.

The resin A is preferably a resin obtained by reacting a monomer mixture using a water-soluble radical generator in an aqueous medium containing a surfactant, or a resin obtained by reacting a monomer mixture using a radical generator in a solvent where the monomer mixture and the radical generator are soluble, from the viewpoints of easily controlling the reaction heat during production and requiring no removal of the solvent after completion of reaction for production.

The weight average molecular weight of the aqueous phase-added resin (the above resin A) is not particularly limited and may be appropriately selected depending on the intended purpose. It is preferably 20,000 to 500,000, more preferably 50,000 to 200,000, particularly preferably 80,000 to 180,000. When the weight average molecular weight is lower than 20,000, the aqueous phase-added resin is degraded in dispersion stabilizing effect for oil droplets, potentially making it difficult to control colored resin particles in particle diameter. When it is higher than 500,000, the aqueous phase-added resin is difficult to dissolve in an aqueous medium, potentially leading to a drop in production stability.

The weight average molecular weight refers to a molecular weight measured through GPC (gel permeation chromatography) and can be measured with, for example, GPC-150C (product of Waters Co.).

--Method for Producing Aqueous Phase-Added Resin--

The method for producing the aqueous phase-added resin is not particularly limited and may be appropriately selected depending on the intended purpose. Examples thereof include radical polymerization, anion polymerization and cation polymerization. Of these, radical polymerization is preferred since it can easily be performed with a relatively simple apparatus. Examples of the radical polymerization include bulk polymerization where polymerizable monomers (monomer compounds) are polymerized without using a solvent or a dispersion medium, solution polymerization where the monomer mixture is allowed to react using a radical generator in a solvent in which the monomer mixture and the radical generator are soluble, suspension polymerization where the monomer mixture containing an oil-soluble radical generator is dispersed in an aqueous medium and allowed to react using the radical generator, and emulsion polymerization where the monomer mixture is allowed to react using a water-soluble radical generator in an aqueous medium in the presence of a surfactant. Of these, from the viewpoint of easily controlling the reaction heat, the solution polymerization, the suspension polymerization and the emulsion polymerization are preferred. From the viewpoint of requiring no removal of the solvent after completion of reaction for production, the suspension polymerization and the emulsion polymerization are more preferred. From the viewpoint of proceeding with polymerization reaction at a high rate, the emulsion polymerization is particularly preferred.

The aqueous phase-added resin obtained by the emulsion polymerization or the suspension polymerization is an aqueous dispersion. This aqueous dispersion can be used for the method for producing colored resin particles, regardless of the particle diameter or the particle size distribution thereof (e.g., the ratio Mv/Mn of volume average particle diameter My and number average particle diameter Mn). Further, there are no problems in using a dispersion liquid having different dispersion diameters, provided that the aqueous phase-added resin has the same composition of polymerizable monomers.

The amount of an emulsifying agent used for the emulsion polymerization is not particularly limited and may be appropriately selected depending on the intended purpose. It is preferably 0.02% by mass to 2% by mass, more preferably 0.05% by mass to 1% by mass, relative to the amount of the obtained aqueous phase-added resin. When it falls within the above preferred range, the emulsifying agent affects the production process of the colored resin particles to a small extent. When it falls within the above more preferred range, the emulsifying agent does not substantially affect the production process of the colored resin particles. The reason for this may be as follows. While the emulsifying agent itself provides emulsification stability at the emulsification step of the production process of the colored resin particles, its amount is much smaller than that of other sub-materials (an emulsifying agent newly added to the aqueous phase-added resin or the aqueous phase, and other materials for controlling emulsification stability). Moreover, a part or the whole of the emulsifying agent used for the emulsion polymerization may be an emulsifying agent having a polymerizable functional group (a so-called reactive emulsifying agent).

Also, a basic compound may be added to the aqueous dispersion of the aqueous phase-added resin obtained by the emulsion polymerization to dissolve the aqueous phase-added resin.

—Basic Compound—

The basic compound is not particularly limited and may be appropriately selected depending on the intended purpose, but is preferably a compound formed of a cation selected from alkali metals and alkaline earth metals and an anion selected from a hydroxyl group, a $COO^{2-}$ group, a $HCOO^{-}$ group, a $PO_4^{3-}$ group, a $HPO_4^{2-}$ group and a $H_2PO_4^{-}$ group.

Examples of the alkali metals include sodium and potassium. Examples of the alkaline earth metals include calcium.

Examples of the basic compound include: inorganic bases such as ammonia, sodium hydroxide, potassium hydroxide, sodium carbonate, potassium carbonate, sodium hydrogencarbonate and potassium hydrogencarbonate; and organic bases such as dimethylamine, diethylamine and triethylamine.

<Dispersion Liquid Preparation Step>

The dispersion liquid preparation step is not particularly limited and may be appropriately selected depending on the intended purpose, so long as it is a step of dispersing the oil phase in the aqueous phase to prepare a core particle dispersion liquid in which core particles formed of the oil phase are dispersed.

When the oil phase is dispersed in the aqueous phase containing the resin A dissolved therein, core particles formed of the oil phase are increased in dispersion stability; i.e., core particles having good dispersion stability can be obtained. The reason for this is not necessarily clear but the following is one possible reason. When the oil phase is dispersed in the aqueous phase obtained by dissolving the resin A in the aqueous medium with the basic compound, the system decreases in pH by the action of, for example, the acid the binder resin has (e.g., an acid described from the resin having a polyester skeleton), or a part of the solvent dissolves in the aqueous phase by the addition of the oil phase to result in that electrolytes of the aqueous phase are difficult to dissociate. Thus, a part of the dissolved resin A cannot keep its dissolved state and is precipitated to cover the interfaces between the oil droplets, stabilizing dispersion of the core particles.

The dispersion method is not particularly limited and may be appropriately selected depending on the intended purpose. Examples thereof include a dispersion method using a known disperser such as a low-speed shearing disperser, a high-speed shearing disperser, a friction disperser, a high-pressure jet disperser or an ultrasonic disperser. Among them, dispersion using a high-speed shearing disperser is preferred in order to form dispersoids having a particle diameter of 2 μm to 20 μm. The rotation speed of the high-speed shearing disperser is not particularly limited but is generally 1,000 rpm to 30,000 rpm, preferably 5,000 rpm to 20,000 rpm. The dispersion time is not particularly limited and may be appropriately selected depending on the intended purpose. It is preferably 0.1 min to 5 min in a batch method. When the dispersion time exceeds 5 min, unfavorable small particles remain and excessive dispersion is performed to make the dispersion system unstable, potentially forming aggregates and coarse particles. The dispersion temperature is not particularly limited and may be appropriately selected depending on the intended purpose. It is generally 0° C. to 40° C., preferably 10° C. to 30° C. When the dispersion temperature is lower than 0° C., the dispersion is increased in viscosity to require increased shearing energy for dispersing, potentially leading to a drop in production efficiency. When it exceeds 40° C., molecular movements are excited to degrade dispersion stability, potentially forming aggregates and coarse particles easily.

To obtain a stable dispersion liquid, a surfactant, an inorganic dispersing agent, a protective colloid, etc., may be used during dispersing.

—Surfactant—

The surfactant is not particularly limited and may be appropriately selected depending on the intended purpose. Examples thereof include anionic surfactants such as alkylbenzenesulfonic acid salts, α-olefin sulfonic acid salts and phosphoric acid esters; cationic surfactants such as amine salts (e.g., alkyl amine salts, aminoalcohol fatty acid derivatives, polyamine fatty acid derivatives and imidazoline), and quaternary ammonium salts (e.g., alkyltrimethylammonium salts, dialkyl dimethylammonium salts, alkyl dimethyl benzyl ammonium salts, pyridinium salts, alkyl isoquinolinium salts and benzethonium chloride); nonionic surfactants such as fatty acid amide derivatives and polyhydric alcohol derivatives; and amphoteric surfactants such as alanine, dodecyldi (aminoethyl)glycine, di(octylaminoethyl)glycine and N-alkyl-N,N-dimethylammonium betaine. Also, use of a fluoroalkyl group-containing surfactant can form a stable dispersion liquid even in a very small amount.

Examples of the fluoroalkyl group-containing surfactants suitably used include fluoroalkyl carboxylic acids having 2 to 10 carbon atoms and metal salts thereof, disodium perfluorooctanesulfonylglutamate, sodium 3-[ω-fluoroalkyl(C6 to C11)oxy)-1-alkyl(C3 or C4) sulfonates, sodium 3-[ω-fluoroalkanoyl(C6 to C8)-N-ethylamino]-1-propanesulfonates, fluoroalkyl(C11 to C20) carboxylic acids and metal salts thereof, perfluoroalkylcarboxylic acids(C7 to C13) and metal salts thereof, perfluoroalkyl(C4 to C12)sulfonates and metal salts thereof, perfluorooctanesulfonic acid diethanol amide, N-propyl-N-(2-hydroxyethyl)perfluorooctanesulfone amide, perfluoroalkyl(C6 to C10)sulfonamide propyltrimethylammonium salts, salts of perfluoroalkyl(C6 to C10)-N-ethylsulfonylglycin and monoperfluoroalkyl(C6 to C16) ethylphosphates. Example of the fluoroalkyl group-containing cationic surfactants include aliphatic primary, secondary or tertiary amine acid containing a fluoroalkyl group, aliphatic quaternary ammonium salts (e.g., perfluoroalkyl(C6 to C10)sulfonamide propyltrimethylammonium salts, benzalkonium salts, benzethonium chloride, pyridinium salts and imidazolinium salts.

In order to efficiently disperse the oil droplets containing the organic solvent, the surfactant used is preferably a disulfonic acid salt having a relatively high HLB. The concentration of the surfactant in the aqueous medium not particularly limited and may be appropriately selected depending on the intended purpose. The concentration thereof is preferably 1% by mass to 10% by mass, more preferably 2% by mass to 8% by mass, particularly preferably 3% by mass to 7% by mass. When the concentration thereof is lower than 1% by mass, the oil droplets cannot be stably dispersed to form coarse oil droplets. When the concentration thereof exceeds 10% by mass, each oil droplet becomes too small and also has a reverse micellar structure. Thus, the dispersion stability is degraded due to the surfactant added in such an amount, to thereby easily form coarse oil droplets.

—Inorganic Dispersing Agent—

The inorganic dispersing agent is not particularly limited and may be appropriately selected depending on the intended purpose. Examples thereof include tricalcium phosphate, calcium carbonate, titanium oxide, colloidal silica and hydroxyapatite.

Use of the inorganic dispersing agent is preferred since a sharp particle size distribution and a stable dispersion state can be attained.

—Protective Colloid—

The protective colloid is not particularly limited and may be appropriately selected depending on the intended purpose. Examples thereof include acids, hydroxyl group-containing (meth)acrylic monomers, ethers of vinyl alcohol, esters formed between vinyl alcohol and a carboxyl group-containing compound, acrylamides, acid chlorides, homopolymers or copolymers of nitrogen-containing compounds and nitrogen-containing heterocyclic compounds, polyoxyethylenes, and celluloses.

Examples of the acids include acrylic acid, methacrylic acid, α-cyanoacrylic acid, α-cyanomethacrylic acid, itaconic acid, crotonic acid, fumaric acid, maleic acid and maleic anhydride.

Examples of the hydroxyl group-containing (meth)acrylic monomers include β-hydroxyethyl acrylate, β-hydroxyethyl methacrylate, β-hydroxypropyl acrylate, γ-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid esters, diethylene glycol monomethacrylic acid esters, glycerin monoacrylic acid esters, glycerin monomethacrylic acid esters, N-methylolacrylamide and N-methylolmethacrylamide).

Examples of the ethers of vinyl alcohol include vinyl methyl ether, vinyl ethyl ether and vinyl propyl ether.

Examples of the esters formed between vinyl alcohol and a carboxyl group-containing compound include vinyl acetate, vinyl propionate and vinyl butyrate.

Examples of the acrylamides include acrylamide, methacrylamide, diacetone acrylamide.

Examples of the acid chlorides include acrylic acid chloride and methacrylic acid chloride.

Examples of the nitrogen-containing heterocyclic compounds include vinyl pyridine, vinyl pyrrolidone, vinyl imidazole and ethyleneimine.

Examples of the polyoxyethylenes include polyoxyethylenes, polyoxypropylenes, polyoxyethylene alkyl amines, polyoxypropylene alkyl amines, polyoxyethylene alkyl amides, polyoxypropylene alkyl amides, polyoxyethylene nonylphenyl ethers, polyoxyethylene laurylphenyl ethers, polyoxyethylene stearylphenyl esters and polyoxyethylene nonylphenyl esters).

Examples of the celluloses include methyl cellulose, hydroxyethyl cellulose and hydroxypropyl cellulose.

When an acid- or alkali-soluble compound (e.g., calcium phosphate) is used as a dispersion stabilizer, the calcium phosphate used is dissolved with an acid (e.g., hydrochloric acid), followed by washing with water, to thereby remove it from the formed particles. Also, the calcium phosphate may be removed through enzymatic decomposition. Alternatively, the dispersing agent used may remain on the surfaces of the toner particles. However, the dispersing agent is preferably removed through washing.

<Fine Resin Particles Attachment Step>

The fine resin particles attachment step is not particularly limited and may be appropriately selected depending on the intended purpose, so long as it is a step of dispersing fine resin particles in an aqueous medium to prepare a fine resin particle dispersion liquid, and adding the fine resin particle dispersion liquid to the core particle dispersion liquid so that the fine resin particles are attached onto the core particles, to thereby prepare a dispersion liquid containing particles each having the core particle and the fine resin particles attached thereonto.

The time required that the fine resin particle dispersion liquid is added the core particle dispersion liquid is not particularly limited and may be appropriately selected depending on the intended purpose. It is preferably 30 sec or longer, more preferably 30 sec to 60 sec. When the time is shorter than 30 sec, the dispersion system drastically changes to form aggregated particles. In addition, the fine resin particles may be ununiformly attached onto the core particles. Meanwhile, adding the fine resin particle dispersion liquid over an unnecessarily long period of time (e.g., 60 min or longer) is not preferred from the viewpoint of lowering production efficiency.

The following may explain the reason why the fine resin particles are sufficiently firmly attached onto the core particles in the fine resin particles attachment step. Specifically, when the fine resin particles are attached onto the liquid droplets of the core particles, the core particles can freely deform to sufficiently form contact surfaces with the fine resin particles and the fine resin particles are swelled with or dissolved in the organic solvent to make it easier for the fine resin particles to adhere to the resin in the core particles. Therefore, in this state, the organic solvent must exist in the system in a sufficiently large amount. Specifically, the amount of the organic solvent contained in the core particle dispersion liquid is preferably 50% by mass to 150% by mass, more preferably 70% by mass to 125% by mass, relative to the amount of the solid matter (e.g., resin, colorant, if necessary, releasing agent and charge controlling agent). When the amount of the organic solvent exceeds 150% by mass, the amount of the colored resin particles obtained through one production process is reduced, resulting in low production efficiency. Also, a large amount of the organic solvent impairs dispersion stability, potentially making it difficult to attain stable production.

The temperature at which the fine resin particles are attached onto the core particles is not particularly limited and may be appropriately selected depending on the intended purpose. It is preferably 10° C. to 60° C., more preferably 20° C. to 45° C. When the temperature is lower than 10° C., the dispersion liquid is increased in viscosity and thus the fine resin particles may be attached insufficiently. When the temperature is higher than 60° C., the energy required for production increases to result in increased environmental load. In addition, the fine resin particles having a low acid value exist on the surfaces of the liquid droplets, potentially leading to unstable dispersion to form coarse particles.

—Fine Resin Particle Dispersion Liquid—

The fine resin particle dispersion liquid is not particularly limited, so long as it is a dispersion liquid where the fine resin particles are dispersed in the aqueous medium, and may be appropriately selected depending on the intended purpose.

--Fine Resin Particles--

The fine resin particles are not particularly limited and may be appropriately selected depending on the intended purpose. They are preferably fine vinyl resin particles since the obtained colored resin particles can have charge stability.

The volume average particle diameter of the fine resin particles is not particularly limited and may be appropriately selected depending on the intended purpose, but is preferably 60 nm to 200 nm.

The volume average particle diameter of the fine resin particles can be measured using UPA-150EX (product of NIKKISO CO., LTD.).

--Fine Vinyl Resin Particles--

The fine vinyl resin particles are not particularly limited and may be appropriately selected depending on the intended purpose. In order for the colored resin particles obtained by the method for producing colored resin particles to be used as charged functional particles such as latent electrostatic image developing toner particles, the colored resin particles each preferably have an easily chargeable surface. Therefore, the fine viny resin particles each preferably has as a constituent component an aromatic compound having a vinyl polymerizable functional group which has electron orbitals where electrons can stably travel as can be seen in aromatic ring structures.

The amount of the aromatic compound having a vinyl polymerizable functional group contained in the constituent components of the fine vinyl resin particles is preferably 50% by mass or more (50% by mass to 100% by mass), more preferably 80% by mass or more (80% by mass to 100% by mass), particularly preferably 95% by mass or more (95% by mass to 100% by mass). When the amount of the aromatic compound having a vinyl polymerizable functional group is less than 50% by mass, the obtained colored resin particles are poor in chargeability, which imposes limitation on applications of the colored resin particles.

That is, the fine vinyl resin particles are preferably produced through polymerization of a monomer mixture containing the aromatic compound having a vinyl polymerizable functional group in an amount of 50% by mass or more, more preferably in an amount of 80% by mass or more, particularly preferably in an amount of 95% by mass or more.

Examples of the polymerizable functional group contained in the aromatic compound having a vinyl polymerizable functional group include a vinyl group, an isopropenyl group, an allyl group, an acryloyl group and a methacryloyl group.

Specific examples of the aromatic compound having a vinyl polymerizable functional group include styrene, α-methylstyrene, 4-methylstyrene, 4-ethylstyrene, 4-tert-butylstyrene, 4-methoxystyrene, 4-ethoxystyrene, 4-carboxystyrene and metal salts thereof; 4-styrenesulfonic acid and metal salts thereof; 1-vinylnaphthalene, 2-vinylnaphthalene, allylbenzene, phenoxyalkylene glycol acrylate, phenoxyalkylene glycol methacrylate, phenoxypolyalkylene glycol acrylates and phenoxypolyalkylene glycol methacrylates.

Of these, styrene is preferred since it is easily available, and has excellent reactivity and high chargeability.

The amount of a compound having a vinyl polymerizable functional group and an acid group in the constituent components of the fine vinyl resin particles is preferably 7% by mass or less (0% by mass to 7% by mass), more preferably 4% by mass or less (0% by mass to 4% by mass), particularly preferably 0% by mass; i.e., such a compound is not contained. When the amount of the compound having a vinyl polymerizable functional group and an acid group exceeds 7% by mass, the obtained vinyl fine resin particles themselves have high dispersion stability. Thus, when such vinyl fine resin particles are added to the dispersion liquid containing oil droplets dispersed in the aqueous phase, they are difficult to attach thereonto at ambient temperature. Or, even when the vinyl fine resin particles have been attached thereonto, they may be exfoliated through the process of solvent removal, washing, drying and treating with external additives. Whereas when the amount of the compound having a vinyl polymerizable functional group and an acid group is 7% by mass or less, the obtained colored resin particles less changes in chargeability depending on the working environment.

That is, the fine vinyl resin particles are preferably produced through polymerization of a monomer mixture containing the compound having a vinyl polymerizable functional group and an acid group in an amount of 7% by mass or less, more preferably in an amount of 4% by mass or less, particularly preferably in an amount of 0% by mass (i.e., a monomer mixture containing no compound having a vinyl polymerizable functional group and an acid group).

Examples of the acid group of the compound having a vinyl polymerizable functional group and an acid group include a carboxyl group, a sulfonyl group and phosphonyl group.

Examples of the compound having a vinyl polymerizable functional group and an acid group include carboxyl group-containing vinyl monomers and salts thereof, sulfonic acid group-containing vinyl monomers, vinyl sulfuric acid monoesters and salts thereof, and phosphoric acid group-containing vinyl monomers and salts thereof.

Examples of the carboxyl group-containing vinyl monomers and salts thereof include acrylic acid, methacrylic acid, maleic acid, monoalkyl maleates, fumaric acid, monoalkyl fumarates, crotonic acid, itaconic acid, monoalkyl itaconate, glycol itaconate monoethers, citraconic acid, monoalkyl citraconates, cinnamic acid, and salts thereof.

Of these, preferred are acrylic acid, methacrylic acid, maleic acid, monoalkyl maleates, fumaric acid and monoalkyl fumarates.

--Method for Producing Fine Resin Particles--

The method for producing the fine resin particles is not particularly limited and may be appropriately selected depending on the intended purpose. Examples thereof include the following (a) to (f);

(a) a method in which a monomer mixture is allowed to undergo polymerization reaction with a suspension polymerization method, an emulsion polymerization method, a seed polymerization method or a dispersion polymerization method, to thereby produce a dispersion liquid of fine resin particles;

(b) a method in which a monomer mixture is allowed to undergo polymerization, and the obtained resin is then pulverized using a fine pulverizer of, for example, mechanically rotating type or jetting type, followed by classifying, to thereby produce fine resin particles;

(c) a method in which a monomer mixture is allowed to undergo polymerization, and the obtained resin is then dissolved in a solvent, followed by spraying of the resultant resin solution, to thereby produce fine resin particles;

(d) a method in which a monomer mixture is allowed to undergo polymerization, the obtained resin is dissolved in a solvent, another solvent is added to the resultant resin solution to precipitate fine resin particles, and then the solvent is removed to obtain fine resin particles; or a method in which a monomer mixture is allowed to undergo polymerization, the obtained resin is dissolved in a solvent with heating, the resultant resin solution is cooled to precipitate fine resin particles, and then the solvent is removed to obtain fine resin particles;

(e) a method in which a monomer mixture is allowed to undergo polymerization, the obtained resin is dissolved in a solvent, the resultant resin solution is dispersed in an aqueous medium in the presence of an appropriate dispersing agent, and then the dispersion liquid is, for example, heated or left under reduced pressure; and (f) a method in which a monomer mixture is allowed to undergo polymerization, the obtained resin is dissolved in a solvent, an appropriate emulsifying agent is dissolved in the resultant resin solution, followed by phase-transfer emulsification with the addition of water.

Of these, method (a) is preferably employed, since fine resin particles can be produced as a dispersion liquid, which is easy to use for the next step.

In the polymerization reaction of method (a), preferably, (i) a dispersion stabilizer is added to the aqueous medium, (ii) the monomer mixture to be allowed to undergo polymerization reaction is made to contain a monomer capable of imparting dispersion stability to the fine resin particles obtained through polymerization (i.e., a reactive emulsifying agent) or the above (i) and (ii) are performed in combination, to thereby impart dispersion stability to the obtained fine resin particles. When neither the dispersion stabilizer nor the reactive emulsifying agent is used, the particles cannot be maintained in a dispersion state whereby the vinyl resin cannot be obtained as fine particles, the obtained fine resin particles are poor in dispersion stability whereby they are poor in storage stability resulting in aggregation during storage, or the particles are degraded in dispersion stability at the fine resin particles attachment step whereby the core particles easily aggregate or combined together resulting in that the finally obtained colored resin particles are degraded in evenness of particle diameter, shape, surface conditions, etc.

The dispersion stabilizer is not particularly limited and may be appropriately selected depending on the intended purpose. Examples thereof include surfactants and inorganic dispersing agents.

The surfactant is not particularly limited and may be appropriately selected depending on the intended purpose. Examples thereof include anionic surfactants such as alkylbenzenesulfonic acid salts, α-olefinsulfonic acid salts and phosphoric acid esters; cationic surfactants such as amine salts (e.g., alkylamine salts, aminoalcohol fatty acid derivatives, polyamine fatty acid derivatives and imidazoline) and quaternary ammonium salts (e.g., alkyltrimethyl ammonium salts, dialkyldimethyl ammonium salts, alkyldimethylbenzyl ammonium salts, pyridinium salts, alkylisoquinolinium salts and benzethonium chloride); nonionic surfactants such as fatty acid amide derivatives and polyalcohol derivatives; and amphoteric surfactants such as alanine, dodecydi(aminoethyl)glycine, di(octylaminoethyl)glycine and N-alkyl-N,N-dimethylammonium betaine.

The inorganic dispersing agent is not particularly limited and may be appropriately selected depending on the intended purpose. Examples thereof include tricalcium phosphate, calcium carbonate, titanium oxide, colloidal silica and hydroxyapatite.

The weight average molecular weight of the fine resin particles is not particularly limited and may be appropriately selected depending on the intended purpose. The weight average molecular weight thereof is preferably 3,000 to 300,000, more preferably 4,000 to 100,000, particularly preferably 5,000 to 50,000. When the weight average molecular weight is lower than 3,000, the fine resin particles have low mechanical strength or are brittle. Thus, the surfaces of the finally obtained colored resin particles easily change depending on the working environment of some applications. For example, the colored resin particles considerably changes in chargeability and/or causes contamination such as attachment onto the surrounding members, which leads to degradation of image quality. Whereas when the weight average molecular weight is higher than 300,000, the number of ends of the molecules is decreased, so that the molecular chains interact with the core particles to a less extent to potentially degrade adhesion to the core particles.

The above weight average molecular weight refers to a molecular weight measured through GPC (gel permeation chromatography) and can be measured by, for example, GPC-150C (product of Waters Co.).

The glass transition temperature (Tg) of the fine resin particles is not particularly limited and may be appropriately selected depending on the intended purpose. It is preferably 40° C. to 100° C., more preferably 50° C. to 95° C., particularly preferably 60° C. to 90° C. When the Tg is lower than 40° C., the finally obtained colored resin particles may be degraded in storage stability, for example, may involve blocking during storage at high temperatures.

The glass transition temperature refers to a glass transition temperature measured through differential scanning calorimety (DSC) and can be measured by, for example, TG-DSC System TAS-100 (product of Rigaku Corporation).

--Aqueous Medium--

The aqueous medium is not particularly limited and may be appropriately selected depending on the intended purpose. Examples thereof include water.

The aqueous medium may be water alone or a mixture of water and a water-miscible solvent. Examples of the water-miscible solvent include alcohols (e.g., methanol, isopropanol and ethylene glycol), dimethylformamide, tetrahydrofuran, cellosolves (e.g., methyl cellosolve) and lower ketones (e.g., acetone and methyl ethyl ketone).

<Solvent Removal Step>

The solvent removal step is not particularly limited and may be appropriately selected depending on the intended purpose, so long as it is a step of removing the organic solvent from the dispersion liquid obtained in the fine resin particles attachment step. In one employable means for removing the organic solvent therefrom, the dispersion liquid of the particles is gradually increased in temperature with stirring, to thereby completely evaporate off the organic solvent contained in the liquid droplets. In another employable means, the dispersion liquid of the particles is sprayed toward a dry atmosphere with stirring, to thereby completely evaporate off the organic solvent contained in the liquid droplets. In still another employable means, the dispersion liquid of the particles is reduced in pressure with stirring to evaporate off the organic solvent. The latter two means may be used in combination with the first means.

The dry atmosphere toward which the dispersion liquid of the particles is not particularly limited and may be appropriately selected depending on the intended purpose. It uses heated gas such as air, nitrogen, carbon dioxide and combustion gas.

The temperature of the dry atmosphere is not particularly limited and may be appropriately selected depending on the intended purpose. It is preferably a temperature equal to or higher than the highest boiling point of the solvents used.

The spraying is performed with, for example, a spray dryer, a belt dryer or a rotary kiln. Using them even in a short time can give a product having satisfactory quality.

<Washing Step>

The washing step is not particularly limited and may be appropriately selected depending on the intended purpose, so long as it is a step of washing the particles after the solvent removal step.

The dispersion liquid of the particles obtained in the above-described method contains not only the colored resin particles but also such subsidiary materials as the dispersing agent (e.g., surfactant). Thus, the dispersion liquid is washed to separate the colored resin particles from the subsidiary materials.

The washing method of the particles is not particularly limited and may be appropriately selected depending on the intended purpose. Examples thereof include a centrifugation method, a reduced-pressure filtration method and a filter press method. Any of the above methods forms a cake of the colored resin particles. If the colored resin particles are not sufficiently washed through only one washing process, the formed cake may be dispersed again in an aqueous medium to form a slurry, which is repeatedly treated with any of the above methods to taken out the colored resin particles. When a reduced-pressure filtration method or a filter press method is employed for washing, an aqueous medium may be made to penetrate the cake to wash out the subsidiary materials contained in the colored resin particles. The aqueous medium used for washing is water or a solvent mixture of water and an alcohol such as methanol or ethanol. Use of water is preferred from the viewpoint of reducing cost and environmental load caused by, for example, drainage treatment.

<Drying Step>

The drying step is not particularly limited and may be appropriately selected depending on the intended purpose, so long as it is a step of drying the particles after the washing step.

The washed colored resin particles containing a large amount of water are dried to remove the water, whereby only colored resin particles can be obtained.

The method for removing water from the colored resin particles is not particularly limited and may be appropriately selected depending on the intended purpose. Examples thereof include methods using dryers such as a spray dryer, a vacuum freezing dryer, a reduced-pressure dryer, a ventilation shelf dryer, a movable shelf dryer, a fluidized-bed-type dryer, a rotary dryer and a stirring-type dryer.

The colored resin particles are preferably dried until the water content is finally decreased less than 1% by mass. Also, when the dry colored resin particles somewhat flocculate to cause inconvenience in use, the flocculated particles may be separated from each other through beating using, for example, a jet mill, HENSCHEL MIXER, a super mixer, a coffee mill, an oster blender or a food processor.

<Other Steps>

Examples of the other steps include an aging step.

—Aging Step—

When the oil phase contains an isocyanate group-containing modified resin, an aging step is preferably performed to proceed with elongation/crosslinking reaction of the isocyanate group-containing modified resin.

The aging step is preferably performed after the solvent removal step and before the washing step.

The aging time in the aging step is not particularly limited and may be appropriately selected depending on the intended purpose. It is preferably 10 min to 40 hours, more preferably 2 hours to 24 hours.

The reaction temperature in the aging step is not particularly limited and may be appropriately selected depending on the intended purpose. It is preferably 0° C. to 40° C., more preferably 15° C. to 30° C.

The colored resin particles produced by the method for producing colored resin particles can suitably be used as a toner for electrophotographic image formation in, for example, copiers, electrostatic printing, printers, facsimiles, and electrostatic recording; and as colored resin particles for use in electronic paper.

(Developer)

A developer of the present invention contains at least colored resin particles; and, if necessary, further contains other components such as a carrier.

The colored resin particles are colored resin particles obtained by the method of the present invention for producing colored resin particles.

The developer is a developer used in an electrophotographic image forming apparatus and image forming method.

The developer uses the colored resin particles as a toner.

The developer may be a one-component developer or a two-component developer.

<Carrier>

The carrier is not particularly limited and may be appropriately selected depending on the intended purpose, but is preferably a carrier having a core material and a resin layer covering the core material.

—Core Material—

The material of the core material is not particularly limited and may be appropriately selected depending on the intended purpose. For example, it is preferable to employ manganese-strontium materials of 50 emu/g to 90 emu/g or manganese-magnesium materials of 50 emu/g to 90 emu/g. Further, it is preferably to employ high magnetization materials such as iron powder of 100 emu/g or more or magnetite of 75 emu/g to 120 emu/g for the purpose of securing image density. Moreover, it is preferably to employ low magnetization materials such as copper-zinc of 30 emu/g to 80 emu/g because the impact toward the photoconductor having the developer in the form of magnetic brush can be relieved and because it is advantageous for higher image quality.

These materials may be used alone or in combination.

The volume average particle diameter of the core materials is not particularly limited and may be appropriately selected depending on the intended purpose. It is preferably 10 μm to 150 μm, more preferably 40 μm to 100 μm. When the volume average particle diameter thereof is less than 10 μm, the amount of fine powder increases in the carrier, and thus magnetization per particle decreases and carrier scattering may occur. When it is greater than 150 μm, the specific surface area of the carrier decreases and thus toner scattering may occur. As a result, in the case of printing a full-color image having many solid portions, the reproduction of the solid portions especially may decrease.

—Resin Layer—

The material of the resin layer is not particularly limited and may be appropriately selected from known resins depending on the intended purpose. Examples thereof include amino-based resins, polyvinyl-based resins, polystyrene-based resins, polyhalogenated olefins, polyester-based resins, polycarbonate-based resins, polyethylenes, polyvinyl fluorides, polyvinylidene fluorides, polytrifluoroethylenes, polyhexafluoropropylenes, copolymers formed of vinylidene fluoride and an acrylic monomer, copolymers formed of vinylidene fluoride and vinyl fluoride, fluoroterpolmers such as copolymers formed of tetrafluoroethylene, vinylidene fluoride and a fluoro group-free monomer, and silicone resins.

These may be used alone or in combination.

The amino-based resins are not particularly limited and may be appropriately selected depending on the intended purpose, and examples thereof include urea-formaldehyde resins, melamine resins, benzoguanamine resins, urea resins, polyamide resins and epoxy resins.

The polyvinyl-based resins are not particularly limited and may be appropriately selected depending on the intended purpose, and examples thereof include acrylic resins, polymethyl mathacrylates, polyacrylonitriles, polyvinyl acetates, polyvinyl alcohols and polyvinyl butyrals.

The polystyrene-based resins are not particularly limited and may be appropriately selected depending on the intended purpose, and examples thereof include polystyrene and styrene-acrylic copolymers.

The polyhalogenated olefins are not particularly limited and may be appropriately selected depending on the intended purpose, and examples thereof include polyvinyl chloride.

The polyester resins are not particularly limited and may be appropriately selected depending on the intended purpose, and examples thereof include polyethylene terephthalate and polybutylene terephthalate.

If necessary, the resin layer may further contain, for example, conductive powder. The conductive powder is not particularly limited and may be appropriately selected depending on the intended purpose, and examples thereof include metal powder, carbon black, titanium oxide, tin oxide and zinc oxide. The average particle diameter of the conductive powder is preferably 1 μm or smaller. When the average particle diameter is in excess of 1 μm, electrical resistance may be difficult to control.

The resin layer may be formed, for example, as follows. Specifically, a silicone resin, etc. are dissolved in a solvent to prepare a coating liquid, and then the thus-prepared coating liquid is applied onto the core surface with a known coating method, followed by drying and then baking.

The coating method is not particularly limited and may be appropriately selected depending on the intended purpose, and examples thereof include immersion coating methods, spray methods and brush coating methods.

The solvent is not particularly limited and may be appropriately selected depending on the intended purpose. Examples thereof include toluene, xylene, methyl ethyl ketone, methyl isobutyl ketone and butyl cellosolve acetate.

The baking method may be an external or internal heating method. Examples of the apparatus for the baking include methods employing a fixed-type electric furnace, a fluid-type electric furnace, a rotary electric furnace or a burner furnace; and methods employing microwave radiation.

The amount of the resin layer contained in the carrier is not particularly limited and may be appropriately selected depending on the intended purpose. It is preferably 0.01% by mass to 5.0% by mass. When the amount is less than 0.01% by mass, a uniform resin layer cannot be formed on the surface of the core material in some cases. Whereas when the amount is more than 5.0% by mass, the formed resin layer becomes too thick to cause adhesion between carrier particles, potentially resulting in failure to form uniform carrier particles.

(Image Forming Apparatus and Image Forming Method)

An image forming apparatus of the present invention contains at least an image bearing member, a latent electrostatic image forming unit, a developing unit, a transfer unit and a fixing unit; preferably contains a cleaning unit; and optionally further contains appropriately selected other units such as a charge-eliminating unit, a recycling unit and a controlling unit.

An image forming method of the present invention contains at least a latent electrostatic image forming step, a developing step, a transfer step and a fixing step; preferably contains a cleaning step; and optionally further contains appropriately selected other steps such as a charge-eliminating step, a recycling step and a controlling step.

The image forming method of the present invention can suitably be performed by the image forming apparatus of the present invention. The latent electrostatic image forming step can be performed by the latent electrostatic image forming unit. The developing step can be performed by the developing unit. The transfer step can be performed by the transfer unit. The fixing step can be performed by the fixing unit. The other steps can be performed by the other units.

The image forming apparatus is preferably an image forming apparatus to which a toner can be replenished.

The image forming method is preferably an image forming method in which a toner can be replenished.

<Latent Electrostatic Image Forming Step and Latent Electrostatic Image Forming Unit>

The latent electrostatic image forming step is a step of forming a latent electrostatic image on the image bearing member.

—Image Bearing Member—

In the image bearing member ("photoconductor" or "latent image bearing member"), its material, shape, structure, size, etc. are not particularly limited and can be appropriately selected from those known in the art. It preferably has a drum shape. Also, the photoconductor is made, for example, of inorganic photoconductor materials (e.g., amorphous silicon and serene) and organic photoconductor materials (e.g., polysilane and phthalopolymethine).

The image bearing member (photoconductor) used in the image forming apparatus of the present invention contains a conductive substrate and at least a photoconductive layer disposed thereon; and, if necessary, further contains other layers.

The photoconductive layer has a single-layer structure in which a charge generating material and a charge transporting material are present in a mixed manner, a normal layer structure in which a charge transporting layer is provided on a charge generating layer, and an inverted layer structure in which a charge generating layer is provided on a charge transporting layer. Additionally, a protecting layer may be provided on the photoconductive layer, in order to improve the mechanical strength, abrasion resistance, gas resistance, cleanability, etc. of the photoconductor. Further, an underlying layer may be provided between the photoconductive layer and the conductive substrate. Also, if necessary, an appropriate amount of a plasticizer, an antioxidant, a leveling agent, etc. may be added to each layer.

The conductive substrate is not particularly limited and may be appropriately selected depending on the intended purpose, so long as it has a conductivity of $1.0\times10^{10}$ Ω·cm or less in volume resistance. Examples thereof include a product formed by coating a film-like or cylindrical piece of plastic or paper with a metal such as aluminum, nickel, chromium, Nichrome, copper, gold, silver or platinum or with a metal oxide such as tin oxide or indium oxide by means of vapor deposition or sputtering; a plate of aluminum, an aluminum alloy, nickel, stainless steel, etc.; and a tube produced by forming the plate into a drum-shaped mother tube by means of extrusion, drawing, etc. and then surface-treating the mother tube by means of cutting, superfinishing, polishing, etc.

The conductive substrate has a drum shape the diameter of which is preferably 20 mm to 150 mm, more preferably 24 mm to 100 mm, still more preferably 28 mm to 70 mm. When the drum-shaped substrate has a diameter of less than 20 mm, it is physically difficult to place therearound members for the steps of charging, exposing, developing, transferring and cleaning. When the drum-shaped substrate has a diameter of greater than 150 mm, it is undesirable because the image forming apparatus is enlarged. Particularly in the case where an image forming apparatus is of tandem type, it is necessary to mount a plurality of photoconductors therein, so that the diameter of the substrate of each photoconductor is preferably 70 mm or less, more preferably 60 mm or less. Also, the endless nickel belt and the endless stainless steel belt disclosed in JP-A No. 52-36016 can be used as conductive substrates.

The underlying layer of the photoconductor may be composed of a single layer or a plurality of layers. Examples thereof include (1) a layer composed mainly of resin, (2) a layer composed mainly of white pigment and resin, and (3) an oxidized metal film obtained by chemically or electrochemically oxidizing the surface of a conductive substrate, with a layer composed mainly of white pigment and resin being preferred.

Examples of the white pigment include metal oxides such as titanium oxide, aluminum oxide, zirconium oxide and zinc oxide. Among them, it is most desirable to use titanium oxide that is superior in preventing penetration of electric charges from the conductive substrate.

Examples of the resin include thermoplastic resins such as polyamide, polyvinyl alcohol, casein and methyl cellulose, and thermosetting resins such as acryl resins, phenol resins, melamine resins, alkyd resins, unsaturated polyesters and epoxy resins. These may be used alone or in combination.

The thickness of the underlying layer is not particularly limited and may be appropriately selected depending on the intended purpose. It is preferably 0.1 μm to 10 μm, more preferably 1 μm to 5 μm.

Examples of the charge generating material of the photoconducive layer include azo pigments such as monoazo pigments, bisazo pigments, trisazo pigments and tetrakisazo pigments; organic pigments and dyes such as triarylmethane dyes, thiazine dyes, oxazine dyes, xanthene dyes, cyanine pigments, styryl pigments, pyrylium dyes, quinacridone pigments, indigo pigments, perylene pigments, polycyclic quinone pigments, bisbenzimidazole pigments, indanthrone pigments, squarylium pigments and phthalocyanine pigments; and inorganic materials such as selenium, selenium-arsenic, selenium-tellurium, cadmium sulfide, zinc oxide, titanium oxide and amorphous silicon. These may be used alone or in combination.

Examples of the charge transporting material of the photoconducive layer include anthracene derivatives, pyrene derivatives, carbazole derivatives, tetrazole derivatives, metallocene derivatives, phenothiazine derivatives, pyrazoline compounds, hydrazone compounds, styryl compounds, styryl hydrazone compounds, enamine compounds, butadiene compounds, distyryl compounds, oxazole compounds, oxadiazole compounds, thiazole compounds, imidazole compounds, triphenylamine derivatives, phenylenediamine derivatives, aminostilbene derivatives and triphenylmethane derivatives. These may be used alone or in combination.

Binder resin(s) used for forming the photoconductive layer is electrically insulative and may be, for example, thermoplastic resins, thermosetting resins, photocurable resins, photoconductive resins which are known per se. Examples of the binder resin include thermoplastic resins such as polyvinyl chloride, polyvinylidene chloride, vinyl chloride-vinyl acetate copolymers, vinyl chloride-vinyl acetate-maleic anhydride copolymers, ethylene-vinyl acetate copolymers, polyvinyl butyrals, polyvinyl acetals, polyesters, phenoxy resins, (meth)acrylic resins, polystyrenes, polycarbonates, polyarylates, polysulfones, polyethersulfones and ABS resins; thermosetting resins such as phenol resins, epoxy resins, urethane resins, melamine resins, isocyanate resins, alkyd resins, silicone resins and thermosetting acrylic resins; polyvinylcarbazole, polyvinylanthracene and polyvinylpyrene. These may be used alone or in combination.

The uppermost surface layer of the photoconductor is provided in order to improve the mechanical strength, abrasion resistance, gas resistance, cleanability, etc. of the photoconductor. The uppermost surface layer is preferably a layer made of a polymer having greater mechanical strength than the photoconductive layer, or a layer formed of a polymer and inorganic filler dispersed in the polymer. The polymer used for the uppermost surface layer may be a thermoplastic resin or a thermosetting resin, with a thermosetting polymer being preferred because it has high mechanical strength and is highly capable of reducing abrasion caused by friction with a cleaning blade. So long as the surface layer is thin, there may be no problem if it does not have charge transporting capability. However, when a surface layer not having charge transporting capability is formed so as to be thick, the photoconductor is easily caused to decrease in sensitivity, increase in electric potential after exposure, and increase in residual potential, so that it is desirable to incorporate the above-mentioned charge transporting material into the surface layer or use a polymer with charge transporting capability for the surface layer.

In general, the photoconductive layer and the uppermost surface layer greatly differ from each other in mechanical strength, so that once the uppermost surface layer is abraded due to friction with the cleaning blade and thusly disappears, the photoconductive layer is immediately abraded. Therefore, when the uppermost surface layer is provided, it is important to make it have a sufficient thickness. The thickness of the uppermost surface layer is preferably 0.1 μm to 12 μm, more preferably 1 μm to 10 μm, particularly preferably 2 μM to 8 μm. When the thickness of the uppermost surface layer is less than 0.1 μm, it is not desirable because the uppermost surface layer is so thin that parts of the surface layer easily disappear due to friction with the cleaning blade, and abrasion of the photosensitive layer progresses at a region corresponding to the missing parts in uppermost the surface layer. When the thickness of the surface layer is greater than 12 μm, it is not desirable because the photoconductor is easily caused to decrease in sensitivity, increase in electric potential after exposure, and increase in residual potential and, especially when a polymer with charge transporting capability is used, the cost of the polymer increases.

As the resin used for the uppermost surface layer, a polymer which is transparent to writing light at the time of image formation and superior in insulation, mechanical strength and adhesiveness is desirable. Examples of such a polymer include resins such as ABS resins, ACS resins, olefin-vinyl monomer copolymers, chlorinated polyethers, acryl resins, allyl resins, phenol resins, polyacetals, polyamides, polyamide-imides, polyallylsulfones, polyethylenes, polypropylenes, polybutylenes, butadiene-styrene copolymers, polyethylene terephthalates, polybutylene terephthalates, polycarbonates, polyethersulfones, polymethylpentenes, polyphenylene oxides, polysulfones, polystyrenes, AS resins, polyurethanes, polyvinyl chlorides, polyvinylidene chlorides and epoxy resins. The polymer exemplified by these may be a thermoplastic resin; however, when a thermosetting resin produced by crosslinkage with a multifunctional crosslinking agent having an acryloyl group, carboxyl group, hydroxyl group, amino group, etc. is used as the polymer to enhance its mechanical strength, the uppermost surface layer increases in mechanical strength and it becomes possible to greatly reduce abrasion caused by friction with the cleaning blade.

As described above, the uppermost surface layer preferably has charge transporting capability. In order for the uppermost surface layer to have charge transporting capability, it is possible to suitably employ, for example, a method in which a polymer used for the uppermost surface layer and the aforementioned charge transporting material are mixed together, or a method in which a polymer having charge transporting capability is used as the uppermost surface layer, with the latter method being preferable because a photoconductor which is highly sensitive and does not increase much in electric potential after exposure or in residual potential can be obtained.

In order for the uppermost surface layer to be increased in mechanical strength, the uppermost surface layer preferably contains fine metal particles, fine metal oxide particles, or other fine particles. Examples of the metal oxide include titanium oxide, tin oxide, potassium titanate, titanium nitride, zinc oxide, indium oxide and antimony oxide. Examples of the other fine particles added for improving abrasion resistance fluorine-containing resins such as polytetrafluoroethylenes, silicone resins, and mixtures containing any of these resins and inorganic materials dispersed in the resin.

The formation of the latent electrostatic image as the next step can be performed with the latent electrostatic image forming unit by uniformly charging the surface of the image bearing member and then imagewise exposing the charged surface to light. The latent electrostatic image forming unit contains, for example, at least a charging device configured to charge the surface of the image bearing member and an exposing device configured to imagewise expose the charged surface of the image bearing member to light.

The charging is performed by, for example, applying voltage to the surface of the image bearing member using the charging device.

The charging device is not particularly limited and may be appropriately selected depending on the intended purpose. Examples thereof include contact-type charging devices known per se having, for example, a conductive or semiconductive roller, brush, film and rubber blade; and non-contact-type charging devices utilizing colona discharge such as corotron and scorotron.

The charging device preferably has a voltage-applying unit configured to apply voltage having an alternative component.

The exposing can be performed by, for example, imagewise exposing the surface of the image bearing member using an exposing device.

The exposing device is not particularly limited, so long as it attains desired imagewise exposure on the surface of the image bearing member charged with the charging device, and may be appropriately selected depending on the intended purpose. Examples of the exposing device include various exposing devices such as a copy optical exposing device, a rod lens array exposing device, a laser optical exposing device and a liquid crystal shutter exposing device.

In the present invention, light may be imagewise applied to the image bearing member from the side facing the photoconductive substrate thereof.

<Developing Step and Developing Unit>

The developing step is a step of developing the latent electrostatic image with a developer to form a visible image.

The developing step is performed using the developer of the present invention.

The formation of the visible image can be performed by, for example, developing the latent electrostatic image with the developer and can be performed by the developing unit.

The developing unit houses the developer of the present invention.

Suitable examples of the developing unit include those containing at least a developing device housing the developer and capable of applying the developer to the latent electrostatic image in a contact or non-contact manner.

The developing device may employ a dry or wet developing process, and may be a single-color or multi-color developing device. Examples of preferred developing devices include those having a rotatable magnetic roller and a stirrer for charging the developer with friction caused during stirring.

In the developing device, colored resin particles (toner particles) and carrier particles are stirred and mixed so that the toner particles are charged by friction generated therebetween. The charged toner particles are retained in the chain-like form on the surface of the rotating magnetic roller to form a magnetic brush. The magnetic roller is disposed proximately to the image bearing member (photoconductor) and thus, some of the toner particles forming the magnetic brush on the magnet roller are electrically transferred onto the surface of the image bearing member (photoconductor). As a result, the latent electrostatic image is developed with the toner particles to form a visible toner image on the surface of the image bearing member (photoconductor).

The developer housed in the developing device may be a one-component developer or a two-component developer so long as it contains the above toner.

<Transfer Step and Transfer Unit>

The transfer step is a step of transferring the visible images to a recording medium. In this step, preferably, the visible images are primarily transferred to an intermediate transfer member, and the thus-transferred visible images are secondarily transferred to the recording medium. Also, toners of two or more colors are used (a full color toner is preferably used). More preferably, the transfer step includes a primary-transferring step for forming a composite transfer image by transferring the visible images to an intermediate member; and a secondary-transferring step for transferring the composite transfer image to a recording medium.

For example, the visible image can be transferred using the transfer unit by charging the image bearing member (photoconductor) with a transfer charger. Preferably, the transfer unit includes a primary-transferring unit configured to form a composite transfer image by transferring the visible images to an intermediate transfer member; and a secondary-transferring unit configured to transfer the composite transfer image to a recording medium.

The intermediate transfer member is not particularly limited and may be appropriately selected from known transfer members depending on the purpose. Examples of preferred intermediate transfer members include a transfer belt.

The image bearing member may be an intermediate transfer member used in image formation performed by a so-called intermediate transfer method in which toner images formed on the photoconductor(s) are primarily transferred so as to be superimposed on top of one another, and then transferred onto a recording medium.

—Intermediate Transfer Member—

The intermediate transfer member preferably has a conductivity of $1.0\times10^{5}$ Ω·cm to $1.0\times10^{11}$ Ω·cm in volume resistance. When the volume resistance is lower than $1.0\times10^{5}$ Ω·cm, a phenomenon of so-called transfer dust may arise in which toner images become unstable owing to electric discharge, when the toner images are transferred from the photoconductors onto the intermediate transfer member. When the volume resistance is higher than $1.0\times10^{11}$ Ω·cm, opposing electric charge of a toner image may remain on the intermediate transfer member and thus an afterimage may appear on the next image, after the toner image has been transferred from the intermediate transfer member onto a recording medium such as paper.

For the intermediate transfer member, a belt-like or cylindrical plastic may, for example, be used which is produced by kneading a thermoplastic resin together with any one or combination of a metal oxide such as tin oxide or indium oxide, a conductive polymer and conductive particles such as carbon black and then subjecting the mixture to extrusion molding. Besides, it is possible to obtain an intermediate transfer member in the form of an endless belt by heating and centrifugally molding a resin solution containing a thermally crosslinkable monomer or oligomer, with the addition of the above-mentioned conductive particles and/or conductive polymer, if necessary.

When the intermediate transfer member is provided with a surface layer, the materials for the surface layer of the photoconductor, excluding the charge transporting material, may be used for the surface layer after suitably subjected to resistance adjustment with the use of a conductive material.

The transfer unit (the primarily transfer unit and the secondarily transfer unit) preferably contains at least a transfer device which transfers through charging a visible image formed on the image bearing member (photoconductor) onto the recording medium. The number of the transfer unit may be one or two or more. Examples of the transfer device include a corona transfer device employing corona discharge, a transfer belt, a transfer roller, a press transfer roller and an adhesive transfer device.

Notably, the recording medium is not particularly limited and may be appropriately selected from known recording media (recording paper).

<Fixing Step and Fixing Unit>

The fixing step is a step of fixing the visible image transferred onto the recording medium using a fixing unit. The fixing may be performed every time when the visible image of each color toner is transferred onto the recording medium. Alternatively, the fixing may be performed at one time on a composite image formed after the visible images of color toners have been superposed on top of one another.

The fixing unit is not particularly limited and may be appropriately selected depending on the purpose. Known heating and pressing units are preferred. Examples of the heating and pressing units include a combination of a heating roller and a pressing roller and a combination of a heating roller, a pressing roller, and an endless belt.

In general, the heating temperature in the heating and pressing unit is preferably 80° C. to 200° C.

Notably, known light fixing devices, etc. may be used as desired in addition to or instead of the fixing step and the fixing device.

<Charge-Eliminating Step and Charge-Eliminating Unit>

The charge-eliminating step is a step of eliminating charges by applying a charge-eliminating bias to the image bearing member, and can suitably be performed by the charge-eliminating unit.

The charge-eliminating unit is not particularly limited, so long as it can apply a charge-eliminating bias to the image bearing member, and may be appropriately selected from known charge-eliminating devices. Examples thereof include a charge-eliminating lamp.

<Cleaning Step and Cleaning Unit>

The cleaning step is a step of removing the electrophotographic toner remaining on the image bearing member, and can be performed by a cleaning unit.

The cleaning unit is preferably provided downstream of the transfer unit but upstream of a protective layer-forming unit.

The cleaning unit is not particularly limited, so long as it can remove the electrophotographic toner remaining on the image bearing member, and may be selected appropriately from known cleaners. Examples thereof include a magnetic blush cleaner, an electrostatic brush cleaner, a magnetic roller cleaner, a blade cleaner, a brush cleaner or a web cleaner.

<Recycling Step and Recycling Unit>

The recycling step is a step of recycling the toner removed in the cleaning step to the developing unit, and can suitably be performed by the recycling unit.

The recycling unit is not particularly limited and may be, for example, a known conveying unit.

<Controlling Step and Controlling Unit>

The controlling step is a step of controlling each of the above steps, and can suitably be performed by the controlling unit.

The controlling unit is not particularly limited, so long as it can control the operation of each unit, and may be selected appropriately depending on the intended purpose. Examples thereof include devices such as a sequencer or a computer.

FIG. 1 illustrates one exemplary image forming apparatus of the present invention. This image forming apparatus contains, in an unillustrated main body casing, a latent image bearing member (1) rotated clockwise in FIG. 1 which is provided therearound with a charging device (2), an exposing device (3), a developing device (4) having the developer (T) of the present invention, a cleaning part (5), an intermediate transfer member (6), a support roller (7), a transfer roller (8), a developing roller (40), a thin layer-forming member (41), a supply roller (42) and an unillustrated charge-eliminating unit, etc.

This image forming apparatus has an unillustrated paper-feeding cassette containing a plurality of recording paper sheets (P), which are exemplary recording media. The recording paper sheets (P) in the paper-feeding cassette are fed one by one with an unillustrated paper-feeding roller to between the intermediate transfer member (6) and the transfer roller (8) serving as a transfer unit. Before fed to therebetween, the recording paper sheet is retained with a pair of registration rollers so that it can be fed at a desired timing.

In this image forming apparatus, while being rotated clockwise in FIG. 1, the latent image bearing member (1) is uniformly charged with the charging device (2). Then, the latent image bearing member (1) is irradiated with laser beams modulated by image date from the exposing device (3), to thereby form a latent electrostatic image. The latent electrostatic image formed on the latent image bearing member (1) is developed with the toner using the developing device (4). Next, the toner image formed with the developing device (4) is transferred from the latent image bearing member (1) to the intermediate transfer member (6) through application of transfer bias. Subsequently, the recording paper sheet (P) is fed to between the intermediate transfer member (6) and the transfer roller (8), whereby the toner image is transferred onto the recording paper sheet (P). Moreover, the recording paper sheet (P) with the toner image is conveyed to an unillustrated fixing unit.

The fixing unit has a fixing roller and a press roller, wherein the fixing roller is heated to a predetermined temperature and the press roller is pressed against the fixing roller at a predetermined pressure. The fixing unit heats and presses the recording paper sheet conveyed from the transfer roller (8), to thereby fix the toner image on the recording paper sheet, which is then discharged to an unillustrated discharge tray.

In the image forming apparatus after the above-described recording process, the latent image bearing member (1), from which the toner image has been transferred by the transfer roller (8) onto the recording paper sheet, is further rotated to reach the cleaning part (5), where the toner remaining on the surface of the latent image bearing member (1) is scraped off. Then, the latent image bearing member (1) is charge-eliminated with an unillustrated charge-eliminating device. The image forming apparatus uniformly charges, with the charging device (2), the latent image bearing member (1) which has been charge-eliminated by the charge-eliminating device, and performs the next image formation in the same manner as described above.

Figure 2:
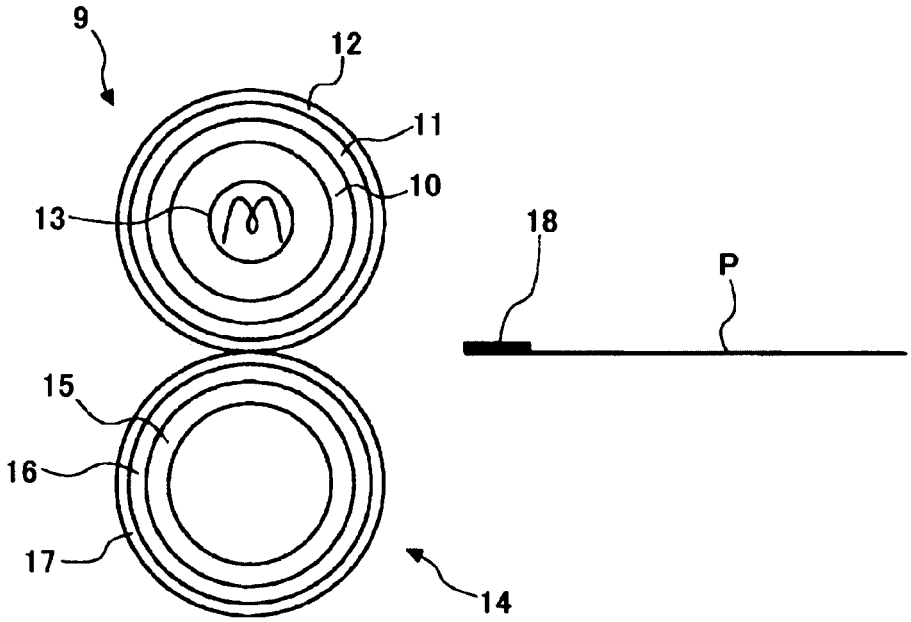
FIG. 2 is a schematic cross-sectional view of one exemplary fixing device used in an image forming method of the present invention.

FIG. 2 is a schematic cross-sectional view of one exemplary fixing device used in the image forming method of the present invention. The fixing device may be a soft roller-type fixing device having fluorine-containing surface layers as illustrated in FIG. 2. This fixing device has a heat roller (9) and a press roller (14). The heat roller (9) has an aluminum core (10), an elastic material layer (11) of silicone rubber, PFA (tetrafluoroethylene-perfluoroalkyl vinyl ether copolymer) surface layer (12) and a heater (13), where the elastic material layer (11) and the PFA surface layer (12) are provided on the aluminum core (10) and the heater (13) is provided inside the aluminum core (10). The press roller (14) has an aluminum core (15), an elastic material layer (16) of silicone rubber and a PFA surface layer (17), where the elastic material layer (16) and the PFA surface layer (17) are provided on the aluminum core (15). Notably, the recording paper sheet (P) having an unfixed image (18) is fed as illustrated.

Figure 3:
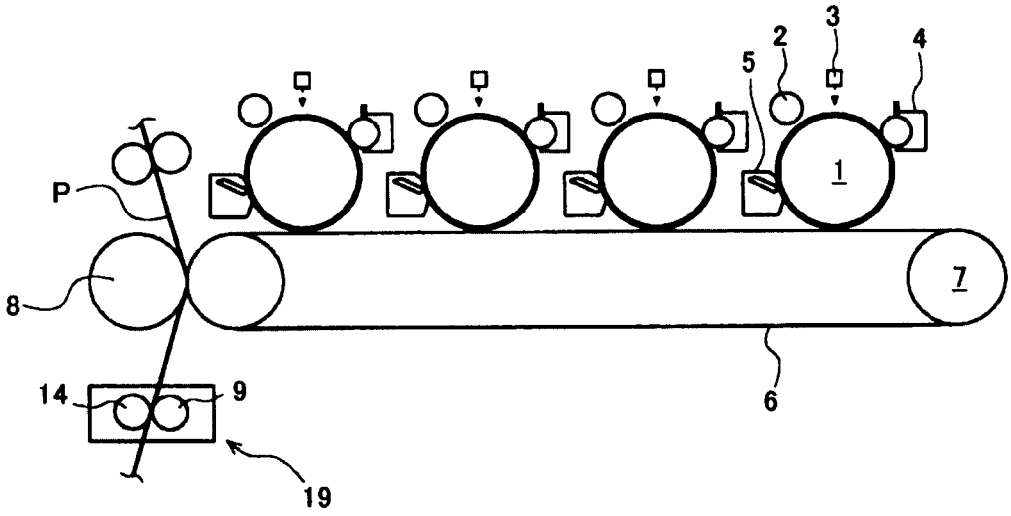
FIG. 3 is a schematic view of a multi-color image forming apparatus to which an image forming apparatus of the present invention is applied.

FIG. 3 is a schematic view of one exemplary multi-color image forming apparatus to which the image forming apparatus of the present invention has been applied. The multi-color image forming apparatus illustrated in FIG. 3 is a tandem-type full color image forming apparatus.

The image forming apparatus of FIG. 3 contains, in an unillustrated main body casing, latent image bearing members (1) rotated clockwise in FIG. 3 which are each provided therearound with a charging device (2), an exposing device (3), a developing device (4), a cleaning part (5), an intermediate transfer member (6), a support roller (7), a transfer roller (8), a heat roller (9), a press roller (14), etc. This image forming apparatus has an unillustrated paper-feeding cassette containing a plurality of recording paper sheets. The recording paper sheets (P) in the paper-feeding cassette are fed one by one with an unillustrated paper-feeding roller to between the intermediate transfer member (6) and the transfer roller (8), followed by fixing with a fixing unit (19). Before fed to therebetween, the recording paper sheet is retained with a pair of registration rollers so that it can be fed at a desired timing.

In this full-color image forming apparatus, while being rotated clockwise in FIG. 3, each of the latent image bearing members (1) is uniformly charged with the corresponding charging device (2). Then, the latent image bearing member (1) is irradiated with laser beams modulated by image date from the corresponding exposing device (3), to thereby form a latent electrostatic image on the latent image bearing member (1). The latent electrostatic image formed on the latent image bearing member (1) is developed with the toner using the corresponding developing device (4). Next, the toner image, which has formed by applying the toner to the latent image bearing member with the developing device (4), is transferred from the latent image bearing member (1) to the intermediate transfer member. The above-described process is performed in four colors of cyan (C), magenta (M), yellow (Y) and black (K), to thereby form a full color toner image.

Figure 4:
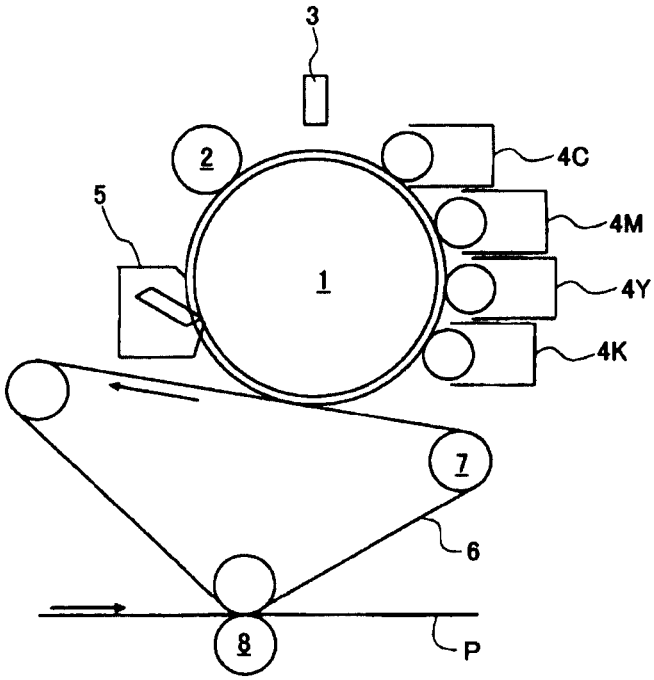
FIG. 4 is a schematic view of one exemplary revolver-type, full-color image forming apparatus to which an image forming apparatus of the present invention is applied.

FIG. 4 is a schematic view of one exemplary full color image forming apparatus of revolver type to which the image forming apparatus of the present invention has been applied. This image forming apparatus includes a latent image bearing member (1) which is provided therearound with a charging device (2), an exposing device (3), developing devices (4C, 4M, 4Y and 4K), a cleaning part (5), etc., and switches the operation of each developing device to sequentially apply color toners onto one latent image bearing member (1) for development. A transfer roller (8) supported by a support roller (7) is used to transfer the color toner image from the intermediate transfer member (6) onto a recording paper sheet (P), which is then conveyed to a fixing part for obtaining a fixed image.

In the image forming apparatus after the toner image has been transferred from the intermediate transfer member (6) onto the recording paper sheet (P), the latent image bearing member (1) is further rotated to reach the cleaning part (5) where the toner remaining on the surface of the latent image bearing member (1) is scraped off by a blade, followed by charge-eliminating. Then, the image forming apparatus uniformly charges, with the charging device (2), the latent image bearing member (1) charge-eliminated at the charge-eliminating part, and performs the next image formation in the same manner as described above. Notably, the cleaning part (5) is limited to the manner in which the toner remaining on the latent image bearing member (1) is scraped off by a blade. For example, the cleaning part (5) may be a part where the toner remaining on the latent image bearing member (1) is scraped off by a fur brush.

(Process Cartridge)

A process cartridge of the present invention includes at least a latent image bearing member and a developing unit containing the developer of the present invention; and, if necessary, further includes other units such as a charging unit, an exposing unit, a transfer unit, a cleaning unit and a charge-eliminating unit.

The process cartridge of the present invention is detachably mounted to various electrophotographic apparatuses, preferably is detachably mounted to the image forming apparatus of the present invention.

Figure 5:
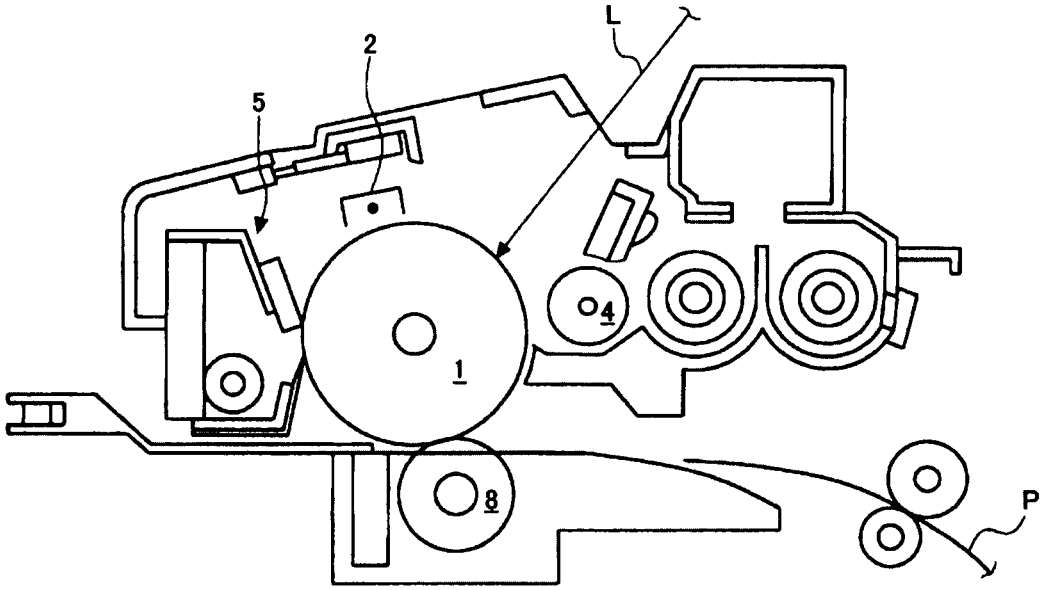
FIG. 5 is a schematic cross-sectional view of one exemplary process cartridge of the present invention.

As illustrated in FIG. 5, the process cartridge includes a latent image bearing member (1), a charging device (2), a developing device (4), a transfer roller (8) and a cleaning part (5); and, if necessary, further includes other units. In FIG. 5, (L) denotes light emitted from an unillustrated exposing device and (P) denotes a recording paper sheet. The latent image bearing member (1) may be the same as that used in the above-described image forming apparatus. The charging device (2) may be any charging member.

Next, description will be given to image forming process by the process cartridge illustrated in FIG. 5. While being rotated clockwise, the latent image bearing member (1) is charged with the charging device (2) and then is exposed to light (L) emitted from the unillustrated exposing unit. As a result, a latent electrostatic image in response to an exposure pattern is formed on the surface of the latent image bearing member (1). The latent electrostatic image is developed with the toner in the developing device (4). The developed toner image is transferred with the transfer roller (8) onto the recording paper sheet (P), which is then printed out. Next, the latent image bearing member surface from which the toner image has been transferred is cleaned in the cleaning part (5), and is charge-eliminated with an unillustrated charge-eliminating unit. The above-described process is repeatedly performed.

EXAMPLES

The present invention will next be described in more detail by way of Examples and Comparative Examples. However, the present invention should not be construed as being limited to these Examples.

In Examples, the unit "part(s)" and "%" mean "part(s) by mass" and "% by mass" unless otherwise specified.

The following evaluation was performed on colored resin particles as a toner which were produced by the method of the present invention for producing colored resin particles. However, the colored resin particles produced by the method of the present invention for producing colored resin particles can suitably be used also for electronic paper.

First will be described measurement methods for physical properties employed in Examples and Comparative Examples.

<Measurement Method for Particle Diameter of Colored Resin Particles>

The volume average particle diameter of the colored resin particles was measured by the Coulter counter method. Examples of employable measurement apparatuses include a Coulter Counter TA-II, Coulter Multisizer II and Coulter Multisizer III (these products are of Coulter, Inc.). The measurement method will next be described. Notably, Coulter Multisizer III was employed in Examples.

First, a surfactant (0.1 mL to 5 mL), preferably an alkylbenzene sulfonic acid salt, was added as a dispersing agent to an electrolyte solution (100 mL to 150 mL). Here, the electrolyte solution was an about 1% aqueous NaCl solution prepared using 1st grade sodium chloride, and examples of commercially available products thereof include ISOTON-II (product of Coulter, Inc.). Subsequently, a measurement sample (2 mg to 20 mg) was suspended in the above-prepared electrolyte solution. The resultant electrolyte solution was dispersed with an ultrasonic wave disperser for about 1 min to about 3 min. The thus-obtained dispersion liquid was analyzed with the above apparatus using an aperture of 100 μm to measure the number or volume of the toner particles or toner. Then, the volume particle size distribution and number particle size distribution were calculated from the obtained values. From these distributions, the volume average particle diameter and number average particle diameter of the toner can be obtained.

Notably, in this measurement, 13 channels were used: 2.00 μm (inclusive) to 2.52 μm (exclusive); 2.52 μm (inclusive) to 3.17 μm (exclusive); 3.17 μm (inclusive) to 4.00 μm (exclusive); 4.00 μm (inclusive) to 5.04 μm (exclusive); 5.04 μm (inclusive) to 6.35 μm (exclusive); 6.35 μm (inclusive) to 8.00 μm (exclusive); 8.00 μm (inclusive) to 10.08 μm (exclusive); 10.08 μm (inclusive) to 12.70 μm (exclusive); 12.70 μm (inclusive) to 16.00 μm (exclusive); 16.00 μm (inclusive) to 20.20 μm (exclusive); 20.20 μm (inclusive) to 25.40 μm (exclusive); 25.40 μm (inclusive) to 32.00 μm (exclusive); and 32.00 μm (inclusive) to 40.30 μm (exclusive); i.e., particles having a particle diameter of 2.00 μm (inclusive) to 40.30 μm (exclusive) were subjected to the measurement.

<Measurement of Volume Average Particle Diameter of Fine Resin Particles>

The volume average particle diameter of the fine resin particles was measured using UPA-150EX (product of NIKKISO CO., LTD.).

The measurement parameters are as follows.

Particle transparency; Transparent

Particle refractive index: 1.59

Particle shape: Truly spherical

Type of solvent: WATER

Monodisperse: Invalid

A sample was prepared so as to have such a concentration that the loading index was in the range of 1 to 1.5 and was measured under the above conditions.

<Measurement of Molecular Weight (GPC)>

The molecular weight of the resin was measured through GPC (gel permeation chromatography) under the following conditions.

Apparatus: GPC-150C (product of Waters Co.)

Column: KF801 to 807 (product of Shodex Co.)

Temperature: 40° C.

Solvent: THF (tetrahydrofuran)

Flow rate: 1.0 mL/min

Sample: 0.1 mL of a sample having a concentration of 0.05% to 0.6% was applied.

From the molecular weight distribution of the resin measured under the above conditions, the number average molecular weight and the weight average molecular weight of the resin were calculated using a molecular weight calibration curve obtained from monodispersed polystyrene standard samples. The standard polystyrene samples used for obtaining the calibration curve were Std. Nos. S-7300, S-210, S-390, S-875, S-1980, S-10.9, S-629, S-3.0 and S-0.580 of Showdex STANDARD (product of SHOWA DENKO K.K.). The detector used was a RI (refractive index) detector.

<Measurement of Glass Transition Temperature (Tg) (DSC)>

The Tg was measured using TG-DSC system TAS-100 (product of Rigaku Denki Co., Ltd.). First, about 5 mg of a sample was placed in an aluminum container, which was placed on a holder unit. The holder unit was then set in an electric oven. The sample was heated from room temperature to 150° C. at a temperature increasing rate of 10° C./min, left to stand at 150° C. for 10 min, cooled to room temperature, and left to stand for 10 min. In a nitrogen atmosphere, the sample was heated again to 150° C. at a temperature increasing rate of 10° C./min. The Tg was obtained based on the calory in this second heating. Using the analysis system of TAS-100 system, the Tg was calculated from the tangent point between the base line and the tangential line of the endothermic curve near the Tg.

<Solubility of Resin A>

The following method was employed to evaluate whether the resin has a solubility less than 2.0 g in 100 g of water having a temperature of 25° C. and a pH of 3.0 and has a solubility equal to or more than 2.0 g in 100 g of water having a temperature of 25° C. and a pH of 10.0.

In the case of a dispersion where the resin is present as fine particles in an aqueous medium; in other words, when the resin is not dissolved in an aqueous medium, the dispersion is opaque as a whole due to scattering caused by the difference in refractive index between the fine resin particles and the medium. Meanwhile, when the resin is dissolved in an aqueous medium, the resultant liquid is a homogeneous phase as a whole not to involve scattering, and thus is transparent. In view of this, whether the resin is dissolved was determined based on transmittance of 600 nm light with respect to the resin dispersion or solution.

First, the resin dispersion was diluted with ion-exchange water while being adjusted in temperature to 25° C., and then further adjusted in pH, to thereby prepare 100 mL of a solution having a pH of 3.0 and a solid content concentration of 2.0% by mass. The pH adjustment was performed using 0.5N aqueous hydrochloric acid solution or 0.5N aqueous sodium hydroxide solution. Notably, the 0.5N aqueous sodium hydroxide solution was used to adjust the pH to 3.0 when the diluted liquid of the resin dispersion had a pH of lower than 3.0.

Next, the pH-adjusted liquid was stirred for 1 hour, and then a sample (2 mL) was taken therefrom and placed in a 1 cm×1 cm quartz cell. One minute after that, the sample was measured at 25° C. for transmittance (%) with respect to light having a wavelength of 600 nm using a UV-Vis spectrophotometer UV2550 (product of SHIMADZU CORPORATION) based on the following equation 1:

$$\text{Transmittance (\%)} = I/I0 \times 100 \qquad \text{Equation 1}$$

where I0 denotes an incident light flux and I denotes a transmitted light flux.

Here, ion-exchange water was used in a reference cell. When the fine resin particle dispersion contained the colorant that was unable to be removed, the colorant was added to ion-exchange water at the same concentration as that of the sample, and the resultant liquid was used in a reference cell.

When the transmittance was 95% or higher, the resin was considered to dissolve in the aqueous medium, and when the transmittance was lower than 95%, the resin was considered not to dissolve in the aqueous medium. That is, when the transmittance was 95% or higher, the target resin had a solubility equal to or more than 2.0 g in 100 g of water having a temperature of 25° C. and a pH of 3.0, and when the transmittance was lower than 95%, the target resin had a solubility less than 2.0 g in 100 g of water having a temperature of 25° C. and a pH of 3.0.

Next, in the same manner as in the above preparation method in which the pH had been adjusted to 3.0, 100 mL of a solution having a pH of 10.0 and a solid content concentration of 2.0% by mass was prepared. The pH adjustment was performed using 2N aqueous sodium hydroxide solution. The pH-adjusted solution was stirred for 1 hour, and then a sample (2 mL) was taken therefrom. The sample was measured at 25° C. for transmittance (%) with respect to light having a wavelength of 600 nm in the same manner as described above, to thereby evaluate whether the resin dissolved in the aqueous medium.

When the transmittance was 95% or higher, the resin was considered to dissolve in the aqueous medium, and when the transmittance was lower than 95%, the resin was considered not to dissolve in the aqueous medium. That is, when the transmittance was 95% or higher, the target resin had a solubility equal to or more than 2.0 g in 100 g of water having a temperature of 25° C. and a pH of 10.0, and when the transmittance was lower than 95%, the target resin had a solubility less than 2.0 g in 100 g of water having a temperature of 25° C. and a pH of 10.0.

Next will be described preparation methods for various materials used in Examples and Comparative Examples.

Production Example 1

Synthesis of Polyester Resin 1

A reaction container equipped with a condenser, a stirrer and a nitrogen-introducing pipe was charged with bisphenol A ethylene oxide 2 mol adduct (229 parts), bisphenol A propylene oxide 2 mol adduct (529 parts), terephthalic acid (208 parts), adipic acid (46 parts) and dibutyl tinoxide (2 parts), followed by reaction at 230° C. for 8 hours under normal pressure. Next, the reaction mixture was allowed to react for 5 hours under a reduced pressure of 10 mmHg to 15 mmHg. Then, trimellitic anhydride (42 parts) was added to the reaction container, followed by reaction at 180° C. for 2 hours under normal pressure, to thereby synthesize [polyester resin 1].

The thus-obtained [polyester resin 1] was found to have a number average molecular weight of 2,500, a weight average molecular weight of 6,700, a glass transition temperature of 43° C. and an acid value of 23 mgKOH/g.

Production Example 2

Synthesis of Polyester Resin 2

A reaction container equipped with a condenser, a stirrer and a nitrogen-introducing pipe was charged with bisphenol A ethylene oxide 2 mol adduct (270 parts), bisphenol A propylene oxide 2 mol adduct (497 parts), terephthalic acid (110 parts), isophthalic acid (102 parts), adipic acid (44 parts) and dibutyl tinoxide (2 parts), followed by reaction at 230° C. for 9 hours under normal pressure. Next, the reaction mixture was allowed to react for 7 hours under a reduced pressure of 10 mmHg to 18 mmHg. Then, trimellitic anhydride (40 parts) was added to the reaction container, followed by reaction at 180° C. for 2 hours under normal pressure, to thereby synthesize [polyester resin 2].

The thus-obtained [polyester resin 2] was found to have a number average molecular weight of 3,000, a weight average molecular weight of 8,600, a glass transition temperature of 49° C. and an acid value of 22 mgKOH/g.

Production Example 3

Synthesis of Polyester Resin 3

A reaction container equipped with a condenser, a stirrer and a nitrogen-introducing pipe was charged with bisphenol A ethylene oxide 2 mol adduct (218 parts), bisphenol A propylene oxide 2 mol adduct (460 parts), terephthalic acid (140 parts), isophthalic acid (145 parts) and dibutyl tinoxide (2 parts), followed by reaction at 230° C. for 8 hours under normal pressure. Next, the reaction mixture was allowed to react for 6 hours under a reduced pressure of 10 mmHg to 18 mmHg. Then, trimellitic anhydride (24 parts) was added to the reaction container, followed by reaction at 180° C. for 2 hours under normal pressure, to thereby synthesize [polyester resin 3].

The thus-obtained [polyester resin 3] was found to have a number average molecular weight of 7,600, a weight average molecular weight of 21,000, a glass transition temperature of 57° C. and an acid value of 15 mgKOH/g.

Production Example 4

Production of Aqueous Phase-Added Resin D-1

A reaction container equipped with a condenser, a stirrer and a nitrogen-introducing pipe was charged with sodium dodecyl sulfate (1.4 parts) and ion-exchange water (498 parts), and the resultant mixture was heated to 80° C. with stirring for dissolution. Then, a solution of potassium persulfate (2.8 parts) in ion-exchange water (110 parts) was added to the resultant solution. Fifteen minutes after, a monomer mixture of styrene monomer (140 parts), methacrylic acid (60 parts) and n-octanethiol (0.3 parts) was added dropwise thereto for 90 min, and the mixture was maintained at 80° C. for 60 min for proceeding with polymerization reaction.

The reaction mixture was cooled to obtain a dispersion liquid of aqueous phase-added resin D-1 of blue white. The aqueous phase-added resin D-1 was found to have a volume average particle diameter (My) of 40 nm and a ratio (Mv/Mn) of 1.14, where My denotes the volume average particle diameter and Mn denotes a number average particle diameter. Then, 2 mL of the obtained dispersion liquid was added to a Petri dish, followed by evaporating of the dispersion medium. The obtained dried matter was found to have a number average molecular weight of 59,200 and a weight average molecular weight of 136,000.

Production Example 5

Production of Aqueous Phase-Added Resin D-2

A reaction container equipped with a condenser, a stirrer and a nitrogen-introducing pipe was charged with sodium dodecyl sulfate (1.4 parts) and ion-exchange water (498 parts), and the resultant mixture was heated to 80° C. with stirring for dissolution. Then, a solution of potassium persulfate (2.7 parts) in ion-exchange water (108 parts) was added to the resultant solution. Fifteen minutes after, a monomer mixture of styrene monomer (160 parts), methacrylic acid (40 parts) and n-octanethiol (0.4 parts) was added dropwise thereto for 90 min, and the mixture was maintained at 80° C. for 60 min for proceeding with polymerization reaction.

The reaction mixture was cooled to obtain a dispersion liquid of aqueous phase-added resin D-2 of blue white. The aqueous phase-added resin D-2 was found to have a volume average particle diameter (Mv) of 51 nm and a ratio (Mv/Mn) of 1.15, where My denotes the volume average particle diameter and Mn denotes a number average particle diameter. Then, 2 mL of the obtained dispersion liquid was added to a Petri dish, followed by evaporating of the dispersion medium. The obtained dried matter was found to have a number average molecular weight of 45,100 and a weight average molecular weight of 103,100.

Production Example 6

Production of Aqueous Phase-Added Resin D-3

A reaction container equipped with a condenser, a stirrer and a nitrogen-introducing pipe was charged with sodium dodecyl sulfate (1.4 parts) and ion-exchange water (498 parts), and the resultant mixture was heated to 80° C. with stirring for dissolution. Then, a solution of potassium persulfate (2.7 parts) in ion-exchange water (110 parts) was added to the resultant solution. Fifteen minutes after, a monomer mixture of styrene monomer (70 parts), n-butyl acrylate (40 parts), methacrylic acid (90 parts) and n-octanethiol (0.2 parts) was added dropwise thereto for 90 min, and the mixture was maintained at 80° C. for 60 min for proceeding with polymerization reaction.

The reaction mixture was cooled to obtain a dispersion liquid of aqueous phase-added resin D-3 of blue white. The aqueous phase-added resin D-3 was found to have a volume average particle diameter (Mv) of 38 nm and a ratio (Mv/Mn) of 1.18, where Mv denotes the volume average particle diameter and Mn denotes a number average particle diameter.

Then, 2 mL of the obtained dispersion liquid was added to a Petri dish, followed by evaporating of the dispersion medium. The obtained dried matter was found to have a number average molecular weight of 69,700 and a weight average molecular weight of 157,000.

The obtained dispersion liquid (10 parts) and ion-exchange water (40 parts) were added to a container equipped with a stirrer. Next, aqueous 10% sodium hydroxide solution was added to the resultant mixture to adjust the pH to 9.3, followed by stirring for 60 min, to thereby obtain a transparent aqueous solution of the aqueous phase-added resin D-3.

Production Example 7

Production of Aqueous Phase-Added Resin D-4

A reaction container equipped with a condenser, a stirrer and a nitrogen-introducing pipe was charged with styrene monomer (138 parts), methacrylic acid (54 parts), acrylamide-2-methylpropanesulfonic acid (8 parts), acetone (60 parts) and 2,2'-azobis(2,4-dimethylvaleronitrile) (4 parts). In a nitrogen atmosphere, the resultant mixture was increased in temperature to 60° C. and polymerized for 10 hours. The reaction mixture was then increased in temperature to 150° C. to remove acetone, to thereby obtain aqueous phase-added resin D-4. The obtained aqueous phase-added resin D-4 was found to have a number average molecular weight of 59,000 and a weight average molecular weight of 153,000.

Production Example 8

Production of Aqueous Phase-Added Resin D-5

A reaction container equipped with a condenser, a stirrer and a nitrogen-introducing pipe was charged with styrene monomer (120 parts), acrylic acid (44 parts), 2-ethylhexyl methacrylate (30 parts), a compound having the following structural formula (6 parts), acetone (60 parts) and 2,2'-azobis (2,4-dimethylvaleronitrile) (4 parts). In a nitrogen atmosphere, the resultant mixture was increased in temperature to 60° C. and polymerized for 10 hours. The reaction mixture was then increased in temperature to 150° C. to remove acetone, to thereby obtain aqueous phase-added resin D-5.

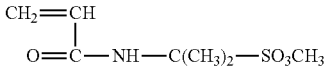

Production Example 9

Production of Aqueous Phase-Added Resin D-6

A reaction container equipped with a condenser, a stirrer and a nitrogen-introducing pipe was charged with styrene monomer (150 parts), acrylic acid (42 parts), a compound having the following structural formula (8 parts), acetone (60 parts) and 2,2'-azobis(2,4-dimethylvaleronitrile) (4 parts). In a nitrogen atmosphere, the resultant mixture was increased in temperature to 60° C. and polymerized for 12 hours. The reaction mixture was then increased in temperature to 150° C. to remove acetone, to thereby obtain aqueous phase-added resin D-6.

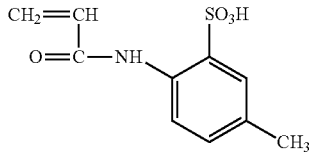

Production Example 10

Production of Aqueous Phase-Added Resin D-7

A reaction container equipped with a condenser, a stirrer and a nitrogen-introducing pipe was charged with sodium dodecyl sulfate (1.3 parts) and ion-exchange water (498 parts), and the resultant mixture was heated to 80° C. with stirring for dissolution. Then, a solution of potassium persulfate (2.5 parts) in ion-exchange water (101 parts) was added to the resultant solution. Fifteen minutes after, a monomer mixture of styrene monomer (140 parts), n-butyl acrylate (44 parts), methacrylic acid (16 parts) and n-octanethiol (0.3 parts) was added dropwise thereto for 90 min, and the mixture was maintained at 80° C. for 60 min for proceeding with polymerization reaction.

The reaction mixture was cooled to obtain a dispersion liquid of aqueous phase-added resin D-7 of white. The aqueous phase-added resin D-7 was found to have a volume average particle diameter (Mv) of 67 nm and a ratio (Mv/Mn) of 1.16, where Mv denotes the volume average particle diameter and Mn denotes a number average particle diameter. Then, 2 mL of the obtained dispersion liquid was added to a Petri dish, followed by evaporating of the dispersion medium. The obtained dried matter was found to have a number average molecular weight of 58,200 and a weight average molecular weight of 123,000.

Table 1 shows properties of the aqueous phase-added resins produced in Production Examples 4 to 10.

TABLE 1

| Prodn. Ex. | Aqueous phase-added resin No. | Polymerization method | Resin composition (parts by mass) St | BA | EHMA | MAA | AA | AMPS | X | Y | Production procedure | Particles Mv (nm) | Mv/Mn | Solubility (g/100 g) 25° C. pH3.0 | 25° C. pH10.0 | Acid value (mgKOH/g) |
|---|---|---|---|---|---|---|---|---|---|---|---|---|---|---|---|---|
| 4 | D-1 | EP | 70 | — | — | 30 | — | — | — | — | EP | 40 | 1.14 | <2.0 | 2.0≤ | 198 |
| 5 | D-2 | EP | 80 | — | — | 20 | — | — | — | — | EP | 51 | 1.15 | <2.0 | 2.0≤ | 135 |
| 6 | D-3 | EP | 35 | 20 | — | 45 | — | — | — | — | EP→addNaOH | 38 | 1.18 | <2.0 | 2.0≤ | 296 |
| 7 | D-4 | SP | 69 | — | — | 27 | — | 4 | — | — | SP→dry | — | — | <2.0 | 2.0≤ | 191 |
| 8 | D-5 | SP | 60 | — | 15 | — | 22 | — | 3 | — | SP→dry | — | — | <2.0 | 2.0≤ | 174 |

TABLE 1-continued

| Prodn. Ex. | Aqueous phase-added resin No. | Polymerization method | Resin composition (parts by mass) St | BA | EHMA | MAA | AA | AMPS | X | Y | Production procedure | Particles Mv (nm) | Mv/M n | Solubility (g/100 g) 25° C. pH3.0 | 25° C. pH10.0 | Acid value (mgKOH/g) |
|---|---|---|---|---|---|---|---|---|---|---|---|---|---|---|---|---|
| 9 | D-6 | SP | 75 | — | — | 21 | — | — | — | 4 | SP→dry | — | — | <2.0 | 2.0≤ | 148 |
| 10 | D-7 | EP | 70 | 22 | — | 8 | — | — | — | — | EP | 67 | 1.16 | <2.0 | <2.0 | 54 |

The abbreviations in Table 1 have the following meanings.
EP: Emulsion polymerization
SP: Solution polymerization
St: Styrene monomer
BA: n-Butyl acrylate
EHMA: 2-Ethylhexyl methacrylate
MAA: Methacrylic acid
AA: Acrylic acid
AMPS: Acrylamide-2-methylpropanesulfonic acid
X: $CH_2{=}CH{-}CONH{-}C(CH_3)_2{-}SO_3CH_3$
Y: A compound having the following structural formula

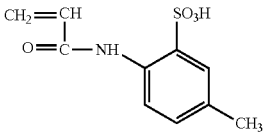

Production Example 11

Production of Aqueous Phase-Added Resin S-1

A reaction container equipped with a condenser, a stirrer and a nitrogen-introducing pipe was charged with sodium dodecyl sulfate (0.7 parts) and ion-exchange water (498 parts), and the resultant mixture was heated to 80° C. with stirring for dissolution. Then, a solution of potassium persulfate (2.6 parts) in ion-exchange water (104 parts) was added to the resultant solution. Fifteen minutes after, a monomer mixture of styrene monomer (200 parts) and n-octanethiol (4.2 parts) was added dropwise thereto for 90 min, and the mixture was maintained at 80° C. for 60 min for proceeding with polymerization reaction.

The reaction mixture was cooled to obtain a dispersion liquid of aqueous phase-added resin S-1 of white. The aqueous phase-added resin S-1 was found to have a volume average particle diameter (Mv) of 135 nm. Then, 2 mL of the obtained dispersion liquid was added to a Petri dish, followed by evaporating of the dispersion medium. The obtained dried matter was found to have a number average molecular weight of 8,300, a weight average molecular weight of 16,900, and a Tg of 83° C.

Production Example 12

Production of Aqueous Phase-Added Resin S-2

A reaction container equipped with a condenser, a stirrer and a nitrogen-introducing pipe was charged with sodium dodecyl sulfate (0.7 parts) and ion-exchange water (498 parts), and the resultant mixture was heated to 80° C. with stirring for dissolution. Then, a solution of potassium persulfate (2.6 parts) in ion-exchange water (104 parts) was added to the resultant solution. Fifteen minutes after, a monomer mixture of styrene monomer (191 parts), n-butyl acrylate (4 parts), methacrylic acid (5 parts) and n-octanethiol (4.2 parts) was added dropwise thereto for 90 min, and the mixture was maintained at 80° C. for 60 min for proceeding with polymerization reaction.

The reaction mixture was cooled to obtain a dispersion liquid of aqueous phase-added resin S-2 of white. The aqueous phase-added resin S-2 was found to have a volume average particle diameter (Mv) of 132 nm. Then, 2 mL of the obtained dispersion liquid was added to a Petri dish, followed by evaporating of the dispersion medium. The obtained dried matter was found to have a number average molecular weight of 8,000, a weight average molecular weight of 16,200, and a Tg of 81° C.

Production Example 13

Production of Aqueous Phase-Added Resin S-3

A reaction container equipped with a condenser, a stirrer and a nitrogen-introducing pipe was charged with sodium dodecyl sulfate (0.7 parts) and ion-exchange water (498 parts), and the resultant mixture was heated to 80° C. with stirring for dissolution. Then, a solution of potassium persulfate (2.6 parts) in ion-exchange water (104 parts) was added to the resultant solution. Fifteen minutes after, a monomer mixture of styrene monomer (184 parts), n-butyl acrylate (6 parts), methacrylic acid (10 parts) and n-octanethiol (4.2 parts) was added dropwise thereto for 90 min, and the mixture was maintained at 80° C. for 60 min for proceeding with polymerization reaction.

The reaction mixture was cooled to obtain a dispersion liquid of aqueous phase-added resin S-3 of white. The aqueous phase-added resin S-3 was found to have a volume average particle diameter (Mv) of 128 nm. Then, 2 mL of the obtained dispersion liquid was added to a Petri dish, followed by evaporating of the dispersion medium. The obtained dried matter was found to have a number average molecular weight of 8,400, a weight average molecular weight of 17,200, and a Tg of 82° C.

Production Example 14

Production of Aqueous Phase-Added Resin S-4

A reaction container equipped with a condenser, a stirrer and a nitrogen-introducing pipe was charged with sodium dodecyl sulfate (0.7 parts) and ion-exchange water (498 parts), and the resultant mixture was heated to 80° C. with stirring for dissolution. Then, a solution of potassium persulfate (2.6 parts) in ion-exchange water (103 parts) was added to the resultant solution. Fifteen minutes after, a monomer mixture of styrene monomer (182 parts), 2-ethylhexyl acrylate (4 parts), acrylic acid (4 parts), 4-methylstyrene (10 parts) and n-octanethiol (4.2 parts) was added dropwise thereto for 90 min, and the mixture was maintained at 80° C. for 60 min for proceeding with polymerization reaction.

The reaction mixture was cooled to obtain a dispersion liquid of aqueous phase-added resin S-4 of white. The aqueous phase-added resin S-4 was found to have a volume average particle diameter (Mv) of 133 nm. Then, 2 mL of the obtained dispersion liquid was added to a Petri dish, followed by evaporating of the dispersion medium. The obtained dried matter was found to have a number average molecular weight of 7,100, a weight average molecular weight of 15,200, and a Tg of 85° C.

Table 2 shows properties of the fine resin particles produced in Production Examples 11 to 14.

TABLE 2

| Prodn. | Fine resin particles | Resin composition (parts by mass) | | | | | | ER | | | Tg | Mv |
|---|---|---|---|---|---|---|---|---|---|---|---|---|
| Ex. | No. | St | pMeSt | BA | 2EHA | MAA | AA | Solid content (%) | Mn | Mw | (° C.) | (nm) |
| 11 | S-1 | 100 | — | — | — | — | — | 25 | 8,300 | 16,900 | 83 | 135 |
| 12 | S-2 | 95.5 | — | 2 | — | 2.5 | — | 25 | 8,000 | 16,200 | 81 | 132 |
| 13 | S-3 | 92 | — | 3 | — | 5 | — | 25 | 8,400 | 17,200 | 82 | 128 |
| 14 | S-4 | 91 | 5 | — | 2 | — | 2 | 25 | 7,100 | 15,200 | 85 | 133 |

The abbreviations in Table 2 have the following meanings.
St: Styrene monomer
pMeSt: 4-Methylstyrene
BA: n-Butyl acrylate
2EHA: 2-Ethylhexyl acrylate
MAA: Methacrylic acid
AA: Acrylic acid

Production Example 15

Synthesis of Prepolymer 1

A reaction container equipped with a condenser, a stirrer and a nitrogen-introducing pipe was charged with bisphenol A ethylene oxide 2 mole adduct (682 parts), bisphenol A propylene oxide 2 mole adduct (81 parts), terephthalic acid (283 parts), trimellitic anhydride (22 parts) and dibutyltin oxide (2 parts). The resultant mixture was allowed to react under normal pressure at 230° C. for 8 hours and further react at a reduced pressure of 10 mmHg to 15 mmHg for 5 hours, to thereby produce [intermediate polyester 1]. The [intermediate polyester 1] was found to have a number average molecular weight of 2,100, a weight average molecular weight of 9,500, a Tg of 55° C., an acid value of 0.5 mgKOH/g, and a hydroxyl value of 49 mgKOH/g.

Next, a reaction container equipped with a condenser, a stirrer and a nitrogen-introducing pipe was charged with 411 parts of the [intermediate polyester 1], 89 parts of isophorone diisocyanate and 500 parts of ethyl acetate, followed by reaction at 100° C. for 5 hours, to thereby produce [prepolymer 1] (isocyanate group-containing polyester prepolymer). The amount of free isocyanate contained in the [prepolymer 1] was found to be 1.53% by mass.

Production Example 16

Preparation of Masterbatch 1

Carbon black (40 parts), [polyester resin 1] (60 parts) and water (30 parts) were mixed together in HENSCHEL MIXER, to thereby obtain a mixture in which water was infiltrated into pigment aggregates. The obtained mixture was kneaded for 45 min with two rollers the surface temperatures of which had been set to 130° C., and then pulverized with a pulverizer to have a size of 1 mm, whereby [masterbatch 1] was obtained.

Example 1

Production of Toner

—Aqueous Phase Preparation Step—

Ion-exchange water (963 parts), the [dispersion liquid of aqueous phase-added resin D-1] (40 parts) and 48.5% aqueous solution of sodium dodecyldiphenyl ether disulfonate (48 parts) were mixed together to prepare a yellow turbid aqueous medium. Thereafter, 10% aqueous sodium hydroxide solution was added to the yellow turbid aqueous medium under stirring to adjust the pH to 10.0. As a result, the aqueous phase-added resin D-1 dissolved in water and the aqueous medium became transparent. The thus-obtained aqueous medium was used as [aqueous phase 1].

—Oil Phase Preparation Step—

A container to which a stirring rod and a thermometer had been set was charged with [polyester resin 1] (545 parts), paraffin wax (melting point: 74° C.) (181 parts) and ethyl acetate (1,450 parts), and the mixture was heated to 80° C. under stirring. The resultant mixture was maintained at 80° C. for 5 hours and then cooled to 30° C. for 1 hour. Subsequently, the [masterbatch 1] (500 parts) and ethyl acetate (100 parts) were charged into the container, followed by mixing for 1 hour, to thereby prepare [raw material solution 1].

The [raw material solution 1] (1,500 parts) was placed in a container, and the pigment and WAX were dispersed with a beads mill (ULTRA VISCOMILL, product of AIMEX CO., Ltd.) under the following conditions: a liquid feed rate of 1 kg/hr, disc circumferential velocity of 6 m/s, 0.5 mm-zirconia beads packed in 80% by volume, and 3 passes. Next, a 66% ethyl acetate solution of the [polyester resin 1] (655 parts) was added thereto, and the resultant mixture was passed once with the beads mill under the above conditions, to thereby obtain [pigment·WAX dispersion liquid 1].

The [pigment·WAX dispersion liquid 1] (976 parts) and the [prepolymer 1] (88 parts) were mixed together with a TK homomixer (product of Tokushu Kika Kogyo Co., Ltd.) at 5,000 rpm for 1 min to thereby obtain [oil phase 1].

—Dispersion Liquid Preparation Step—

The [aqueous phase 1] (1,200 parts) was added to the obtained [oil phase 1]. The resultant mixture was mixed for 2 min with a TK homomixer at 8,000 rpm to 15,000 rpm. In order to prevent the mixture from being increased in temperature due to heat generated through shearing applied by the mixer, the mixture was cooled in a water bath so that the liquid temperature fell within a range of 20° C. to 23° C. during this mixing. The thus-treated mixture was stirred for 10 min with THREE-ONE MOTOR equipped with an anchor impeller at 130 rpm to 350 rpm, to thereby obtain [core particle slurry 1] in which oil phase liquid droplets to be core particles were dispersed in the aqueous phase. Then, 1 mL of the [core particle slurry 1] was sampled and diluted with ion-exchange water to have a volume of 10 mL, followed by centrifugating. The supernatant was found to be substantially transparent.

—Fine Resin Particles Attachment Step—

The [dispersion liquid of fine resin particles S-1] (106 parts) and ion-exchange water (71 parts) were mixed together (solid content concentration: 15%). The resultant mixture was added dropwise for 3 min to the [core particle slurry 1] which was being maintained at 22° C. and stirred with THREE-ONE MOTOR equipped with an anchor impeller at 130 rpm to 350 rpm. After completion of dropwise addition, the mixture was stirred for 30 min with the rotation number adjusted to fall within a range of 200 rpm to 450 rpm, to thereby obtain [composite particle slurry 1] containing particles each having the core particle and the fine resin particles attached thereto.

—Solvent Removal Step—

The [composite particle slurry 1] was charged into a container equipped with a stirrer and a thermometer, and desolvated with stirring at 30° C. for 8 hours to obtain [dispersion slurry 1].

—Washing Step—

After the [dispersion slurry 1] (100 parts) had been filtrated under reduced pressure, (1): ion-exchange water (100 parts) was added to the filtration cake, followed by mixing with a TK homomixer (at 12,000 rpm for 10 min) and then filtrating.

(2): Ion-exchange water (900 parts) was added to the filtration cake obtained in (1), followed by mixing with a TK homomixer (at 12,000 rpm for 30 min) under application of ultrasonic vibration and then filtrating under reduced pressure. This treatment was repeated until the electrical conductivity of the reslurry was 10 μC/cm or lower.

(3): 10% Hydrochloric acid was added to the reslurry obtained in (2) so as to have a pH of 4, followed by stirring with THREE-ONE MOTOR for 30 min and then filtrating.

(4): Ion-exchange water (100 parts) was added to the filtration cake obtained in (3), followed by mixing with a TK homomixer (at 12,000 rpm for 10 min) and then filtrating. This treatment was repeated until the electrical conductivity of the reslurry was 10 μC/cm or lower, to thereby obtain [filtration cake 1].

—Drying Step—

The [filtration cake 1] was dried with an air-circulating drier at 32° C. for 48 hours, and then was caused to pass through a sieve with a mesh size of 75 μm, to thereby prepare [toner base 1]. The obtained [toner base 1] was observed under an electron microscope, and was found to uniformly have concave and convex portions in the surface thereof. Large particles (protrusions) with a size of 1.5 μm or more were not observed.

Next, the toner base (100 parts) was mixed with hydrophobic silica (0.5 parts) and hydrophobic titanium oxide (0.5 parts) using HENSCHEL MIXER to thereby produce toner 1.

<Evaluation>

—Measurement of Particle Diameter of Toner—

The obtained toner (colored resin particles) was measured for particle diameter by the above-described method. The results are shown in Table 3.

—Surface Conditions of Toner—

The surface conditions of the toner were observed under a SEM (scanning electron microscope) at a magnification of ×5,000. Specifically, the surfaces of 50 toner particles were observed for the presence of large particles (protrusions) having a diameter of 1.5 μm or more, and evaluated according to the following criteria. The results are shown in Table 3.

A: No protrusions based on large particles having a diameter of 1.5 vim or more were observed, and the protrusions were uniformly formed.

B: No protrusions based on large particles having a diameter of 1.5 μm or more were observed, but the protrusions were somewhat sparsely formed.

C: One to four protrusions based on large particles having a diameter of 1.5 μm or more were observed.

D: Five or more protrusions based on large particles having a diameter of 1.5 μm or more were observed.

—Image Evaluation—

The toner was charged into the toner cartridge of an image forming apparatus (IPSIO CX2500, product of Ricoh Company Ltd.), followed by printing of a predetermined pattern having an image occupation rate of 5% under normal-temperature, normal-humidity conditions (23° C., 45% RH). The blank portion of the obtained image was measured for L* using X-RITE-938 (product of X-RITE). Lower L* indicates that the toner is attached onto the blank portion. Specifically, a L* of lower than 90 is quite problematic in practical use since the blank portion is clearly colored.

Example 2

Production of Toner

The procedure of Example 1 was repeated, except that the [dispersion liquid of fine resin particles S-1] was changed to the [dispersion liquid of fine resin particles S-2], to thereby produce toner 2.

The obtained toner was evaluated in the same manner as in Example 1. The results are shown in Table 3.

Example 3

Production of Toner

The procedure of Example 1 was repeated, except that the [dispersion liquid of fine resin particles S-1] was changed to the [dispersion liquid of fine resin particles S-3], to thereby produce toner 3.

The obtained toner was evaluated in the same manner as in Example 1. The results are shown in Table 3.

Example 4

Production of Toner

The procedure of Example 1 was repeated, except that the [dispersion liquid of fine resin particles S-1] was changed to the [dispersion liquid of fine resin particles S-4], to thereby produce toner 4.

The obtained toner was evaluated in the same manner as in Example 1. The results are shown in Table 3.

Example 5

Production of Toner

The procedure of Example 1 was repeated, except that the [aqueous phase 1] was changed to [aqueous phase 2] produced in the following aqueous phase preparation step, to thereby produce toner 5.

Notably, in the dispersion liquid preparation step, 1 mL of the [core particle slurry] was sampled and diluted with ion-exchange water to have a volume of 10 mL, followed by centrifugating. The supernatant was found to be substantially transparent.

The obtained toner was evaluated in the same manner as in Example 1. The results are shown in Table 3.

—Aqueous Phase Preparation Step—

Ion-exchange water (966 parts), the [dispersion liquid of aqueous phase-added resin D-2] (40 parts) and 48.5% aqueous solution of sodium dodecyldiphenyl ether disulfonate (99 parts) were mixed together to prepare a yellow turbid aqueous medium. Thereafter, 10% aqueous potassium hydroxide solution was added to the yellow turbid aqueous medium under stirring to adjust the pH to 10.5. As a result, the aqueous phase-added resin D-2 dissolved in water whereby a transparent aqueous medium was obtained. The thus-obtained aqueous medium was used as [aqueous phase 2].

Example 6

Production of Toner

The procedure of Example 1 was repeated, except that the [aqueous phase 1] was changed to [aqueous phase 3] produced in the following aqueous phase preparation step, to thereby produce toner 6.

Notably, in the dispersion liquid preparation step, 1 mL of the [core particle slurry] was sampled and diluted with ion-exchange water to have a volume of 10 mL, followed by centrifugating. The supernatant was found to be substantially transparent.

The obtained toner was evaluated in the same manner as in Example 1. The results are shown in Table 3.

—Aqueous Phase Preparation Step—

Ion-exchange water (816 parts), the [dispersion liquid of aqueous phase-added resin D-3] (200 parts) and 48.5% aqueous solution of sodium dodecyldiphenyl ether disulfonate (99 parts) were mixed together. Thereafter, 10% aqueous sodium hydroxide solution was added to the resultant mixture under stirring to adjust the pH to 9.6. As a result, the aqueous phase-added resin D-3 dissolved in water whereby a yellow transparent aqueous medium was obtained. The thus-obtained aqueous medium was used as [aqueous phase 3].

Example 7

Production of Toner

The procedure of Example 1 was repeated, except that the [aqueous phase 1] was changed to [aqueous phase 4] produced in the following aqueous phase preparation step, to thereby produce toner 7.

Notably, in the dispersion liquid preparation step, 1 mL of the [core particle slurry] was sampled and diluted with ion-exchange water to have a volume of 10 mL, followed by centrifugating. The supernatant was found to be substantially transparent.

The obtained toner was evaluated in the same manner as in Example 1. The results are shown in Table 3.

—Aqueous Phase Preparation Step—

Ion-exchange water (996 parts), the [dispersion liquid of aqueous phase-added resin D-4] (10 parts) and 48.5% aqueous solution of sodium dodecyldiphenyl ether disulfonate (39 parts) were mixed together. Thereafter, 10% aqueous sodium hydroxide solution was added to the resultant mixture to adjust the pH to 9.8, followed by stirring for 1 hour. As a result, the aqueous phase-added resin D-4 dissolved in water whereby a transparent aqueous medium was obtained. The thus-obtained aqueous medium was used as [aqueous phase 4].

Example 8

Production of Toner

The procedure of Example 1 was repeated, except that the [aqueous phase 1] was changed to [aqueous phase 5] produced in the following aqueous phase preparation step, that the [oil phase 1] was changed to [oil phase 2] produced in the following oil phase preparation step, and that the [core particle slurry 1] was changed to [core particle slurry 2] produced in the following dispersion liquid preparation step, to thereby produce toner 8.

The obtained toner was evaluated in the same manner as in Example 1. The results are shown in Table 3.

—Aqueous Phase Preparation Step—

Ion-exchange water (967 parts), the [dispersion liquid of aqueous phase-added resin D-1] (40 parts) and 48.5% aqueous solution of sodium dodecyldiphenyl ether disulfonate (98 parts) were mixed together to prepare a yellow turbid aqueous medium. Thereafter, 10% aqueous sodium hydroxide solution was added under stirring to the resultant mixture to adjust the pH to 10.2. As a result, the aqueous phase-added resin D-1 dissolved in water whereby a transparent aqueous medium was obtained. The thus-obtained aqueous medium was used as [aqueous phase 5].

—Oil Phase Preparation Step—

A container to which a stirring rod and a thermometer had been set was charged with [polyester resin 2] (175 parts), [polyester resin 3] (430 parts), paraffin wax (melting point: 74° C.) (153 parts) and ethyl acetate (1,450 parts), and the mixture was heated to 80° C. under stirring. The resultant mixture was maintained at 80° C. for 5 hours and then cooled to 30° C. for 1 hour. Subsequently, the [masterbatch 1] (410 parts) and ethyl acetate (100 parts) were charged into the container, followed by mixing for 1 hour, to thereby prepare [raw material solution 2].

The [raw material solution 2] (1,500 parts) was placed in a container, and the pigment and WAX were dispersed with a beads mill (ULTRA VISCOMILL, product of AIMEX CO., Ltd.) under the following conditions: a liquid feed rate of 1 kg/hr, disc circumferential velocity of 6 m/s, 0.5 mm-zirconia beads packed in 80% by volume, and 3 passes. Next, a 70% ethyl acetate solution of the [polyester resin 2] (470 parts), a 55% ethyl acetate solution of the [polyester resin 3] (250 parts), and ethyl acetate (95 parts) were added thereto, and passed once with the beads mill under the above conditions, to thereby obtain [oil phase 2].

—Dispersion Liquid Preparation Step—

The [aqueous phase 5] (1,200 parts) was added to the obtained [oil phase 2] (976 parts). The resultant mixture was mixed for 2 min with a TK homomixer at 8,000 rpm to 15,000 rpm, to thereby obtain [core particle slurry 2] containing particles each having the core particle and the fine resin particles attached thereto. Then, 1 mL of the [core particle slurry 2] was sampled and diluted with ion-exchange water to have a volume of 10 mL, followed by centrifugating. The supernatant was found to be substantially transparent.

Example 9

Production of Toner

The procedure of Example 1 was repeated, except that the [aqueous phase 1] was changed to [aqueous phase 6] produced in the following aqueous phase preparation step, to thereby produce toner 9.

Notably, in the dispersion liquid preparation step, 1 mL of the [core particle slurry] was sampled and diluted with ion-exchange water to have a volume of 10 mL, followed by centrifugating. The supernatant was found to be substantially transparent.

The obtained toner was evaluated in the same manner as in Example 1. The results are shown in Table 3.

—Aqueous Phase Preparation Step—

Ion-exchange water (996 parts), the [aqueous phase-added resin D-5] (10 parts) and 48.5% aqueous solution of sodium dodecyldiphenyl ether disulfonate (41 parts) were mixed together. Thereafter, 10% aqueous sodium hydroxide solution was added to the resultant mixture to adjust the pH to 10.3, followed by stirring for 1 hour. As a result, the aqueous phase-added resin D-5 dissolved in water whereby a transparent aqueous medium was obtained. The thus-obtained aqueous medium was used as [aqueous phase 6].

Example 10

Production of Toner

The procedure of Example 1 was repeated, except that the [aqueous phase 1] was changed to [aqueous phase 7] produced in the following aqueous phase preparation step, to thereby produce toner 10.

Notably, in the dispersion liquid preparation step, 1 mL of the [core particle slurry] was sampled and diluted with ion-exchange water to have a volume of 10 mL, followed by centrifugating. The supernatant was found to be substantially transparent.

The obtained toner was evaluated in the same manner as in Example 1. The results are shown in Table 3.

—Aqueous Phase Preparation Step—

Ion-exchange water (996 parts), the [aqueous phase-added resin D-6] (10 parts) and 48.5% aqueous solution of sodium dodecyldiphenyl ether disulfonate (25 parts) were mixed together. Thereafter, 10% aqueous sodium hydroxide solution was added under stirring to the resultant mixture to adjust the pH to 9.4, followed by stirring for 1 hour. As a result, the aqueous phase-added resin D-6 dissolved in water whereby a transparent aqueous medium was obtained. The thus-obtained aqueous medium was used as [aqueous phase 7].

Comparative Example 1

Production of Toner

—Aqueous Phase Preparation Step—

Ion-exchange water (967 parts), the [dispersion liquid of aqueous phase-added resin D-1] (40 parts) and 48.5% aqueous solution of sodium dodecyldiphenyl ether disulfonate (98 parts) were mixed together to prepare a yellow turbid [aqueous phase 8].

—Dispersion Liquid Preparation Step—

The [aqueous phase 8] (1,200 parts) was added to the [oil phase 1] obtained in Example 1. The resultant mixture was mixed for 2 min with a TK homomixer at 8,000 rpm to 15,000 rpm. In order to prevent the mixture from being increased in temperature due to heat generated through shearing applied by the mixer, the mixture was cooled in a water bath so that the liquid temperature fell within a range of 20° C. to 23° C. during this mixing. The thus-treated mixture was stirred for 10 min with THREE-ONE MOTOR equipped with an anchor impeller at 130 rpm to 350 rpm, to thereby obtain [core particle slurry 3] in which oil phase liquid droplets to be core particles were dispersed in the aqueous phase. Then, 1 mL of the [core particle slurry 3] was sampled and diluted with ion-exchange water to have a volume of 10 mL, followed by centrifugating. The supernatant was found to be somewhat turbid.

—Fine Resin Particles Attachment Step—

The [dispersion liquid of fine resin particles S-1] (106 parts) and ion-exchange water (71 parts) were mixed together (solid content concentration: 15%). The resultant mixture was added dropwise for 3 min to the [core particle slurry 3] which was being maintained at 22° C. and stirred with THREE-ONE MOTOR equipped with an anchor impeller at 130 rpm to 350 rpm. After completion of dropwise addition, the mixture was stirred for 30 min with the rotation number adjusted to fall within a range of 200 rpm to 450 rpm, to thereby obtain [composite particle slurry 3] containing particles each having the core particle and the fine resin particles attached thereto.

—Solvent Removal Step—

The [composite particle slurry 3] was charged into a container equipped with a stirrer and a thermometer, and desolvated with stirring at 30° C. for 8 hours to obtain [dispersion slurry 3].

—Washing Step—

After the [dispersion slurry 3] (100 parts) had been filtrated under reduced pressure, (1): ion-exchange water (100 parts) was added to the filtration cake, followed by mixing with a TK homomixer (at 12,000 rpm for 10 min) and then filtrating.

(2): Ion-exchange water (900 parts) was added to the filtration cake obtained in (1), followed by mixing with a TK homomixer (at 12,000 rpm for 30 min) under application of ultrasonic vibration and then filtrating under reduced pressure. This treatment was repeated until the electrical conductivity of the reslurry was 10 μC/cm or lower.

(3): 10% Hydrochloric acid was added to the reslurry obtained in (2) so as to have a pH of 4, followed by stirring with THREE-ONE MOTOR for 30 min and then filtrating.

(4): Ion-exchange water (100 parts) was added to the filtration cake obtained in (3), followed by mixing with a TK homomixer (at 12,000 rpm for 10 min) and then filtrating. This treatment was repeated until the electrical conductivity of the reslurry was 10 μC/cm or lower, to thereby obtain [filtration cake 2].

—Drying Step—

The [filtration cake 2] was dried with an air-circulating drier at 32° C. for 48 hours, and then was caused to pass through a sieve with a mesh size of 75 μm, to thereby prepare [toner base 2]. The obtained [toner base 2] was observed under an electron microscope, and was found to have concave and convex portions in the surface thereof. However, some of the toner base particles were found to have large particles (protrusions) with a size of 1.5 μm or more and have ununiform surface conditions.

Next, the toner base (100 parts) was mixed with hydrophobic silica (0.5 parts) and hydrophobic titanium oxide (0.5 parts) using HENSCHEL MIXER to thereby produce toner 11.

The obtained toner was evaluated in the same manner as in Example 1. The results are shown in Table 3.

Comparative Example 2

The procedure of Example 1 was repeated, except that the [aqueous phase 1] was changed to [aqueous phase 9] produced in the following aqueous phase preparation step, to thereby produce toner 12.

Notably, in the dispersion liquid preparation step, 1 mL of the [core particle slurry] was sampled and diluted with ion-exchange water to have a volume of 10 mL, followed by centrifugating. The supernatant was found to be substantially transparent.

The obtained toner base particles were observed under an electron microscope, and were found to have concave and convex portions in the surface thereof. However, some of the toner base particles were found to have large particles (protrusions) with a size of 1.5 μm or more and have ununiform surface conditions.

The obtained toner was evaluated in the same manner as in Example 1. The results are shown in Table 3.

—Aqueous Phase Preparation Step—

Ion-exchange water (966 parts), the [dispersion liquid of aqueous phase-added resin D-7] (40 parts) and 48.5% aqueous solution of sodium dodecyldiphenyl ether disulfonate (99 parts) were mixed together to prepare a yellow turbid aqueous medium. Thereafter, 10% aqueous sodium hydroxide solution was added under stirring to the resultant mixture to adjust the pH to 10.0. The obtained aqueous medium did not become transparent. This aqueous medium was used as [aqueous phase 9].

In contrast, through observation under an electron microscope, each of the toner base particles obtained in Comparative Examples 1 and 2 was found to have concave and convex portions in the surface thereof, but some of the toner base particles were found to have large particles (protrusions) having a diameter of 1.5 μm or more and also have ununiform surface conditions. The obtained toner particles (colored resin particles) were poor in particle diameter and surface conditions.

In addition, the toners obtained in Examples 1 to 10 were found to exhibit good image evaluation results; i.e., a L* of 90 or more, while the toners obtained in Comparative Examples 1 and 2 were found to exhibit a L* of less than 90; i.e., colored blank portions problematic in practical use.

The method of the present invention for producing colored resin particles can stably produce colored resin particles having consistent quality, and thus is a suitable method for producing: a toner used for electrophotographic image formation in, for example, copiers, electrostatic printing, printers, facsimiles, and electrostatic recording; and colored resin particles used for electronic paper.

This application claims priority to Japanese application No. 2011-022955, filed on Feb. 4, 2011, and incorporated herein by reference.

What is claimed is:

1. A method for producing colored resin particles, comprising:

(i) dissolving or dispersing at least a binder resin and a colorant in an organic solvent to prepare an oil phase;

(ii) dissolving resin A and a basic compound in an aqueous medium to prepare an aqueous phase, where the resin A has a solubility of less than 2.0 g in 100 g of an acidic aqueous solvent having a pH of 3.0 at a temperature of 25° C. and a solubility of equal to or more than 2.0 g in 100 g of a basic aqueous solvent having a pH of 10.0 at a temperature of 25° C.;

(iii) dispersing the oil phase in the aqueous phase to prepare a core particle dispersion liquid in which core particles formed of the oil phase are dispersed;

TABLE 3

| | Toner (colored resin particles) | | | | | | | | | |
|---|---|---|---|---|---|---|---|---|---|---|
| | | Aqueous phase | | | Dispersion | | Evaluation results of toner | | | |
| | No. | Aqueous phase-added resin No. | pH | Transparency | liquid preparation step Supernatant | Fine resin particles No. | Dv (μm) | Dv/Dn | Surface conditions of toner | Image evaluation (L*) |
| Ex. 1 | 1 | D-1 | 10.0 | tp | tp | S-1 | 6.8 | 1.13 | A | 92.8 |
| Ex. 2 | 2 | D-1 | 10.0 | tp | tp | S-2 | 6.9 | 1.12 | B | 91.6 |
| Ex. 3 | 3 | D-1 | 10.0 | tp | tp | S-3 | 6.8 | 1.14 | B | 91.1 |
| Ex. 4 | 4 | D-1 | 10.0 | tp | tp | S-4 | 6.7 | 1.14 | B | 91.9 |
| Ex. 5 | 5 | D-2 | 10.5 | tp | tp | S-1 | 7.9 | 1.12 | A | 92.6 |
| Ex. 6 | 6 | D-3 | 9.6 | tp | tp | S-1 | 6.9 | 1.13 | A | 92.5 |
| Ex. 7 | 7 | D-4 | 9.8 | tp | tp | S-1 | 7.1 | 1.14 | A | 92.6 |
| Ex. 8 | 8 | D-1 | 10.2 | tp | tp | S-1 | 7.0 | 1.14 | A | 92.3 |
| Ex. 9 | 9 | D-5 | 10.3 | tp | tp | S-1 | 6.5 | 1.12 | A | 92.9 |
| Ex. 10 | 10 | D-6 | 9.4 | tp | tp | S-1 | 6.7 | 1.15 | A | 92.2 |
| Comp. Ex. 1 | 11 | D-1 | 5.9 | op | sl. op | S-1 | 6.7 | 1.16 | D | 88.5 |
| Comp. Ex. 2 | 12 | D-7 | 10.0 | op | sl. op | S-1 | 6.8 | 1.17 | D | 86.2 |

The abbreviations in Table 3 have the following meanings.
tp: Transparent
op: Opaque
sl. op: Slightly opaque Through observation under an electron microscope, each of the toner base particles obtained in Examples 1 to 10 was found to uniformly have concave and convex portions in the surface thereof, and to have no large particles (protrusions) having a diameter of 1.5 μm or more. Also, the obtained toner particles (colored resin particles) were uniform in particle diameter and good in surface conditions.

(iv) dispersing fine resin particles in an aqueous medium to prepare a fine resin particle dispersion liquid, and adding the fine resin particle dispersion liquid to the core particle dispersion liquid, prepare thereby obtaining a combined dispersion liquid, wherein the combined dispersion liquid comprises particles each comprising the core particle with the fine resin particles attached;

(v) removing the organic solvent from the combined dispersion liquid; and (vi) subsequently washing and then drying the particles each comprising the core particle with the fine resin particles attached, thereby obtaining the colored resin particles.

2. The method according to claim 1, wherein the resin A is a resin obtained by reacting a monomer mixture comprising at least a monomer compound having a structure of Formula (I) and a monomer compound of Formula (II), the monomer compound having a structure of Formula (I) is in an amount of from 20% by mass to 80% by mass relative to a total constituent monomers of the resin, and the monomer compound of Formula (II) is in an amount of from 15% by mass to 65% by mass relative to the total constituent monomers of the resin:

Formula (I)

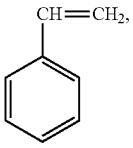

Formula (II)

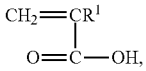

wherein $R^1$ is a hydrogen atom or a methyl group.

3. The method according to claim 2, wherein the monomer mixture further comprises a monomer compound of Formula (III):

Formula (III)

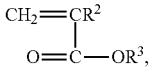

wherein $R^2$ is a hydrogen atom or a methyl group, and $R^3$ is a C1-C22 hydrocarbon group.

4. The method according to claim 2, wherein the monomer mixture further comprises a monomer compound of Formula (IV):

Formula (IV)

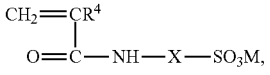

wherein $R^4$ is a hydrogen atom or a methyl group,

X is a divalent hydrocarbon group, and

M is a hydrogen atom, sodium, potassium or a C1-C4 hydrocarbon group.

5. The method according to claim 2, wherein the resin A is a resin obtained by reacting the monomer mixture in the presence of a water-soluble radical generator in an aqueous medium comprising a surfactant.

6. The method according to claim 2, wherein the resin A is a resin obtained by reacting the monomer mixture in the presence of a radical generator in a solvent where the monomer mixture and the radical generator are soluble.

7. The method according to claim 1, wherein the binder resin is a resin comprising a polyester skeleton.

8. The method according to claim 7, wherein the resin comprising a polyester skeleton is a polyester resin.

9. The method according to claim 1, wherein the oil phase further comprises an isocyanate group-comprising modified resin.

10. The method according to claim 9, wherein the isocyanate group-comprising modified resin comprises a polyester skeleton.

11. The method according to claim 9, wherein the oil phase further comprises an amine compound comprising a divalent or higher valent amino group reactive with the isocyanate group of the isocyanate group-comprising modified resin.

12. The method according to claim 1, wherein the basic compound is a compound of a cation selected from the group consisting of an alkali metal and an alkaline earth metal, and an anion selected from the group consisting of a hydroxyl group, a $COO^{2-}$ group, a $HCOO^-$ group, a $PO_4^{3-}$ group, a $HPO_4^{2-}$ group and a $H_2PO_4^-$ group.

13. The method according to claim 1, wherein the fine resin particles are fine vinyl resin particles.

14. The method according to claim 13, wherein the fine vinyl resin particles are obtained by polymerizing a monomer mixture comprising in an amount of 7% by mass or less a compound comprising a vinyl polymerizable functional group and an acid group.

15. The method according to claim 13, wherein the fine vinyl resin particles are obtained by polymerizing a monomer mixture comprising in an amount of 80% by mass or more an aromatic compound comprising a vinyl polymerizable functional group.

16. The method according to claim 2, wherein the monomer mixture further comprises a monomer compound comprising a plurality of polymerizable functional groups in an amount of less than 1% by mass relative to the total constituent monomers of the resin.

17. The method according to claim 1, wherein the resin A has an acid value of from 100 mgKOH/g to 300 mgKOH/g.

18. The method according to claim 1, wherein the resin A has a weight average molecular weight of from 20,000 to 500,000.

19. The method according to claim 1, wherein, in (iv), the core particle with the fine resin particles attached occurs at a temperature of from 10° C. to 60° C.

* * * * *